US009831582B2

(12) United States Patent
Ito et al.

(10) Patent No.: US 9,831,582 B2
(45) Date of Patent: Nov. 28, 2017

(54) CABLE CONNECTION STRUCTURE AND CABLE CONNECTOR INCLUDING SAME

(71) Applicant: YAMAICHI ELECTRONICS CO., LTD., Tokyo (JP)

(72) Inventors: Toshiyasu Ito, Togane (JP); Yosuke Takai, Sakura (JP)

(73) Assignee: YAMAICHI ELECTRONICS CO., LTD., Tokyo (JP)

( * ) Notice: Subject to any disclaimer, the term of this patent is extended or adjusted under 35 U.S.C. 154(b) by 0 days.

(21) Appl. No.: 15/616,645

(22) Filed: Jun. 7, 2017

(65) Prior Publication Data

US 2017/0271797 A1 Sep. 21, 2017

Related U.S. Application Data

(63) Continuation-in-part of application No. 15/007,500, filed on Jan. 27, 2016, now Pat. No. 9,711,883.

(30) Foreign Application Priority Data

Jan. 29, 2015 (JP) ..... 2015-016108

(51) Int. Cl.
*H01R 24/00* (2011.01)
*H01R 12/77* (2011.01)

(52) U.S. Cl.
CPC ..... *H01R 12/77* (2013.01)

(58) Field of Classification Search
CPC ..... H01R 12/61; H01R 12/59; H01R 12/77; H01R 12/78; H01R 12/79; H01R 12/775; H01R 12/596
USPC ..... 439/629, 260, 493, 495, 497, 499
See application file for complete search history.

(56) References Cited

U.S. PATENT DOCUMENTS

| | | | | |
|---|---|---|---|---|
| 7,736,164 | B2 | 6/2010 | Okamura | |
| 8,167,631 | B2 | 5/2012 | Ito et al. | |
| 8,242,374 | B2 * | 8/2012 | Chuo | H05K 1/118 174/250 |
| 8,313,342 | B2 * | 11/2012 | Lin | H01R 12/775 174/254 |
| 8,342,869 | B2 | 1/2013 | Okamura | |
| 8,622,767 | B2 | 1/2014 | Nakazura et al. | |
| 9,065,227 | B2 | 6/2015 | Ashibu et al. | |
| 9,559,449 | B2 * | 1/2017 | Ishida | H01R 12/73 |
| 9,601,853 | B2 * | 3/2017 | Ishida | H01R 12/732 |
| 9,711,883 | B2 * | 7/2017 | Ito | H01R 12/88 |
| 2013/0309887 | A1 | 11/2013 | Honda | |

(Continued)

FOREIGN PATENT DOCUMENTS

JP 5573651 7/2014

OTHER PUBLICATIONS

U.S. Office Action dated Nov. 10, 2016 from U.S. Appl. No. 15/007,500.

(Continued)

*Primary Examiner* — Hae Moon Hyeon
(74) *Attorney, Agent, or Firm* — Katten Muchin Rosenman LLP

(57) ABSTRACT

A cable connector includes a connection end portion of a flexible board, in which a rectangular reinforcing plate molded of a conductive resin material is fixed to part of an upper surface of a ground plate. The connection end portion of the flexible board is electrically connected to a printed circuit board through the cable connector.

4 Claims, 24 Drawing Sheets

(56) References Cited

U.S. PATENT DOCUMENTS

| | | | | |
|---|---|---|---|---|
| 2016/0198572 | A1* | 7/2016 | Ishida | H01R 12/88<br>439/629 |
| 2016/0204531 | A1* | 7/2016 | Ishida | H01R 12/77<br>439/65 |
| 2016/0204532 | A1* | 7/2016 | Ishida | H05K 1/117<br>439/61 |
| 2016/0204534 | A1* | 7/2016 | Ishida | H01R 12/88<br>439/61 |
| 2017/0181282 | A1* | 6/2017 | Ishida | H05K 1/144 |

OTHER PUBLICATIONS

U.S. Notice of Allowance dated Mar. 15, 2017 from U.S. Appl. No. 15/007,500.

* cited by examiner

CABLE CONNECTION STRUCTURE AND CABLE CONNECTOR INCLUDING SAME

CROSS-REFERENCES TO RELATED APPLICATIONS

This application is a continuation-in-part of application Ser. No. 15/007,500 filed on Jan. 27, 2016, which claims the benefit of Japanese Patent Application No. 2015-016108, filed Jan. 29, 2015. The disclosures of the prior applications are hereby incorporated by reference herein in their entirety.

BACKGROUND OF THE INVENTION

Field of the Invention

The present invention relates to a cable connection structure and a cable connector including the same.

Description of the Related Art

In an optical communication system, a transceiver module is put into practical use in order to transmit an optical signal, which is transmitted through an optical connector and the like, to a mother board. As disclosed in Japanese Patent No. 5573651, for example, the transceiver module comprises the following components in a housing as its main elements, namely: a transmitting optical sub-assembly (hereinafter also referred to as TOSA), a receiving optical sub-assembly (hereinafter also referred to as ROSA), a first circuit board and a second circuit board configured to perform signal processing, control, and the like for the TOSA and the ROSA, and a connector portion electrically connecting the first circuit board as well as the second circuit board to a host device.

The electrical connection between the TOSA and the first circuit board, and the electrical connection between the ROSA and the first circuit board are connected by using flexible boards, respectively. The electrical connection between the first circuit board and the second circuit board is also connected by using a flexible board.

In some cases, connecting work of connection terminals of the TOSA and the ROSA as well as connection terminals of the first circuit board and the second circuit board to connection end portions of the above-mentioned flexible boards may be carried out manually by an expert on soldering work, because quality of connection at the connection end portions of the flexible boards may adversely affect signal characteristics of the transceiver module when a communication speed (transfer efficiency) in the transceiver module is relatively high.

SUMMARY OF THE INVENTION

However, when the connecting work of the connection terminals of the first circuit board and the second circuit board and the like to the connection end portions of the flexible boards in the above-described transceiver module is carried out in the soldering work by hand, quality of the signal characteristics of the transceiver module may become unstable due to variation in work quality. In particular, when the transmission speed in the transceiver module is 25 Gbps or more, such variation in work quality may adversely affect the signal characteristics of the transceiver module.

In view of the above-described problem, the present invention aims to provide a cable connection structure and a cable connector including the same. The cable connection structure and a cable connector including the same can stabilize work quality in connecting a connection end portion of a flexible board to a circuit board, and maintain high quality in signal characteristics of a transceiver module even when a communication speed in the transceiver module is relatively high.

To achieve the above-described object, a cable connection structure according to an aspect of the present invention comprises: a connection end portion of a flexible cable, the flexible cable having a group of contact pads formed at least at one ends of a plurality of signal lines configured to transmit a signal and one ends of a plurality of ground lines to be grounded, a ground plate electrically connected to the plurality of ground lines with respect to the contact pads, and a reinforcing plate provided on a surface of the ground plate with respect to the contact pads, the connection end portion which the ground plate and the reinforcing plate are oppositely joined to the group of contact pads; the connection end portion comprises: a plurality of contact terminals each having a contact portion to come into contact with a corresponding one of the contact pads, the contact terminals provided in a housing, being configured to electrically connect the connection end portion of the cable to a wiring board; and a lever member connected to the housing, the lever member configured to press the contact pads against the contact portion of the plurality of contact terminals and to hold the connection end portion.

The ground plate may have a plurality of extension portions formed at a given interval along a direction of arrangement of the contact terminals. In addition, a ground plate piece to be electrically connected to the ground line may further be formed between the extension portions adjacent to each other. Moreover, a plurality of ground plate pieces to be electrically connected to the ground lines may further be formed away from the ground plate and disposed at a given interval along the direction of arrangement of the contact terminals.

A cable connection structure according to an aspect of the present invention comprises: a connection end portion of a flexible cable, the flexible cable having a group of contact pads formed at least at one ends of a plurality of signal lines configured to transmit a signal and one ends of a plurality of ground lines to be grounded, a ground plate electrically connected to the plurality of ground lines with respect to the contact pads, and a reinforcing plate provided on a surface of the ground plate with respect to the contact pads, the connection end portion which the ground plate and the reinforcing plate are oppositely joined to the group of contact pads;

the connection end portion comprising:

a plurality of contact terminals each having a contact portion to come into contact with a corresponding one of the contact pads, the contact terminals provided in a housing, being configured to electrically connect the connection end portion of the cable to a wiring board, wherein the connection end portion is held in the housing due to elastic repulsion of the contact portion of the plurality of contact terminals pressed against the group of contact pads.

A cable connector according to the aspect of the present invention comprises: the above-described cable connection structure; the housing is configured to detachably accommodate the connection end portion of the cable; and the lever member is configured to press the connection end portion of the cable against the contact portions of the contact terminals and to thus detachably hold the connection end portion in the housing. Additionally, the cable connector may further include a conductive connection member provided to the housing and configured to come into contact with fixed portions of the plurality of contact terminals electrically connected to ground line conductive layers of the cable to be connected. The reinforcing plate may be made of a conductive resin material.

The cable connection structure and the cable connector including the same according to the aspect of the present invention comprise: the connection end portion of the flexible cable that is provided with a group of contact pads formed at least at one ends of a plurality of signal lines configured to transmit a signal and one ends of a plurality of ground lines to be grounded, the ground plate electrically connected to the plurality of ground lines with respect to the contact pads, and the reinforcing plate provided on the surface of the ground plate with respect to the contact pads, the connection end portion being configured to join the ground plate and the reinforcing plate to the group of contact pads while locating the ground plate and the reinforcing plate opposite to the group of contact pads; and the plurality of contact terminals each having the contact portion to come into contact with the corresponding one of the group of contact pads, the contact terminals being configured to electrically connect the connection end portion of the cable to the wiring board. Thus, it is possible to stabilize work quality in connecting the connection end portion of the flexible board to a circuit board, and to maintain high quality in signal characteristics of a transceiver module when a communication speed in the transceiver module becomes relatively high.

Further features of the present invention will become apparent from the following description of exemplary embodiments (with reference to the attached drawings).

DESCRIPTION OF THE EMBODIMENTS

Figure 2:
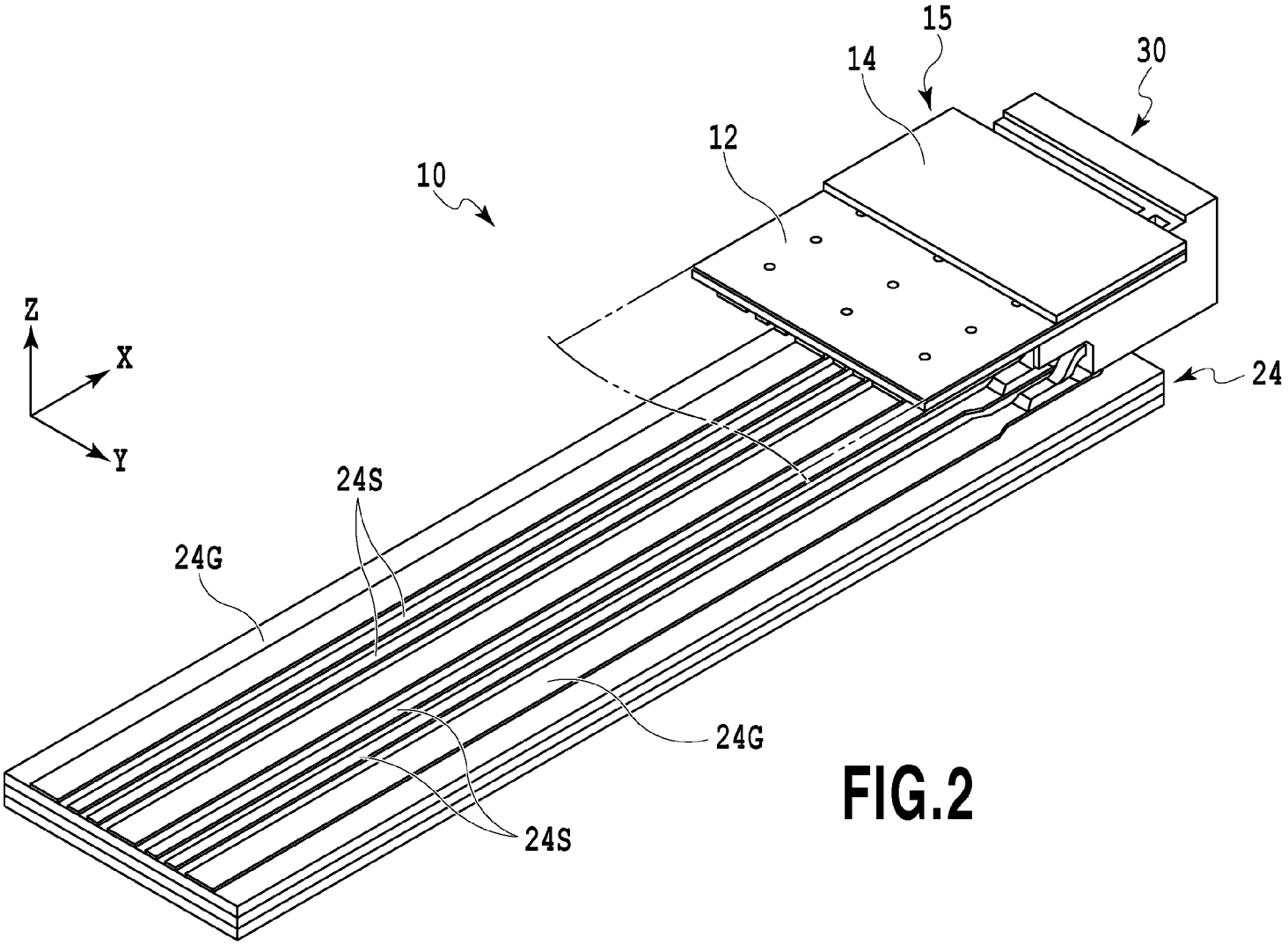
FIG. 2 is a perspective view showing a first embodiment of the cable connection structure according to the present invention together with the substantial part of the cable connector fixed to a printed circuit board.

FIG. 2 shows a cable connector, to which a first embodiment of a cable connection structure according to the present invention is applied, together with a printed circuit board.

Figure 3:
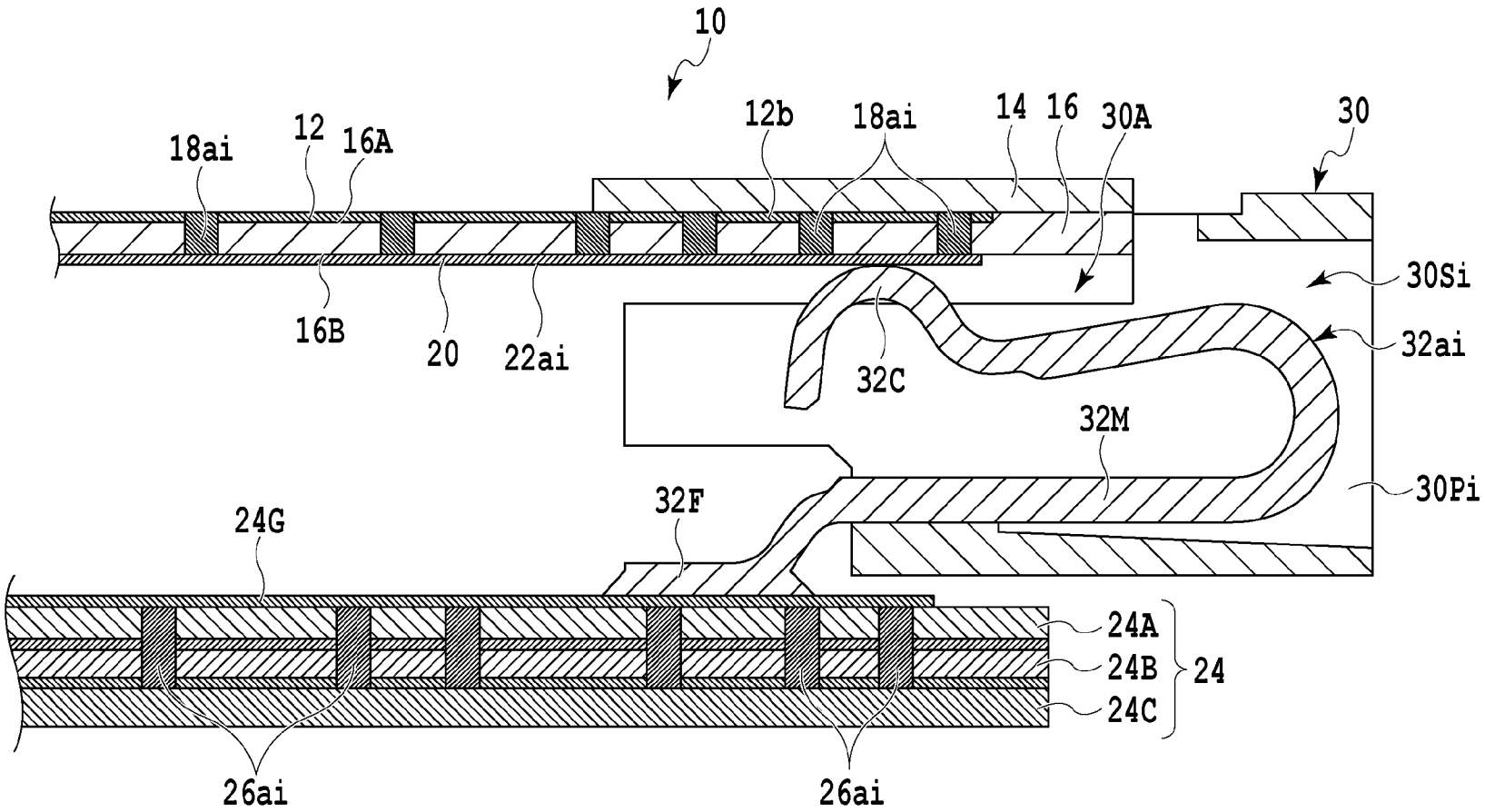
FIG. 3 is a partial cross-sectional view taken along a line in FIG. 1.

As shown in FIG. 3, for example, a printed circuit board 24 is formed into a multilayer structure which comprises a first board 24A, a second board 24B, and a third board 24C. The second board 24B is stacked on an upper surface of the third board 24C. The first board 24A is also stacked on an upper surface of the second board 24B. A conductive layer of the first board 24A and a conductive layer of the second board 24B are electrically connected to each other through a plurality of vias 26*ai* (i=1 to n, n is a positive integer).

For example, a signal processing circuit which includes, among other things, an electronic device (not shown) and the like configured to convert optical signals that are supplied from a receiving optical sub-assembly (hereinafter also referred to as an ROSA) through a flexible board 10 and contact terminals 32*ai* (i=1 to 13) of a cable connector 30 to be described later into electric signals, is formed on a mounting surface of the first board 24A of the printed circuit board 24. The signal processing circuit is connected to one end of each of a plurality of signal layers 24S and a plurality of ground layers 24G (see FIG. 2) formed on the mounting surface of the first board 24A. Moreover, the signal processing circuit is electrically connected to a connector which is configured to send out formed electric signals to the outside. It is to be noted that, although another end of the flexible board 10 is connected to the ROSA in this example, the present invention is not limited to this example and the other end of the flexible board 10 may be connected to a TOSA (transmitting optical sub-assembly).

The plurality of signal layers 24S and the plurality of ground layers 24G of the first board 24A extend parallel to an X coordinate axis in the Cartesian coordinates shown in FIG. 2, i.e., along a longitudinal direction of the printed circuit board 24, respectively. Here, as shown in FIG. 2, the plurality of signal layers 24S and the plurality of ground layers 24G are formed sequentially from one end to the other end of the printed circuit board 24 at given intervals along a Y coordinate axis in the order of a ground layer 24G, a signal layer 24S, another signal layer 24S, and another ground layer 24G, and so on. Note that FIG. 2 representatively illustrates some of the ground layers 24G and the signal layers 24S of the printed circuit board 24.

Another end of each of the plurality of signal layers 24S and of the plurality of ground layers 24G is connected to a fixed terminal portion 32F of the corresponding one of the contact terminals 32*ai* of the cable connector 30 (see FIG. 3). Note that FIG. 2 representatively illustrates part of the cable connector 30.

Figure 4:
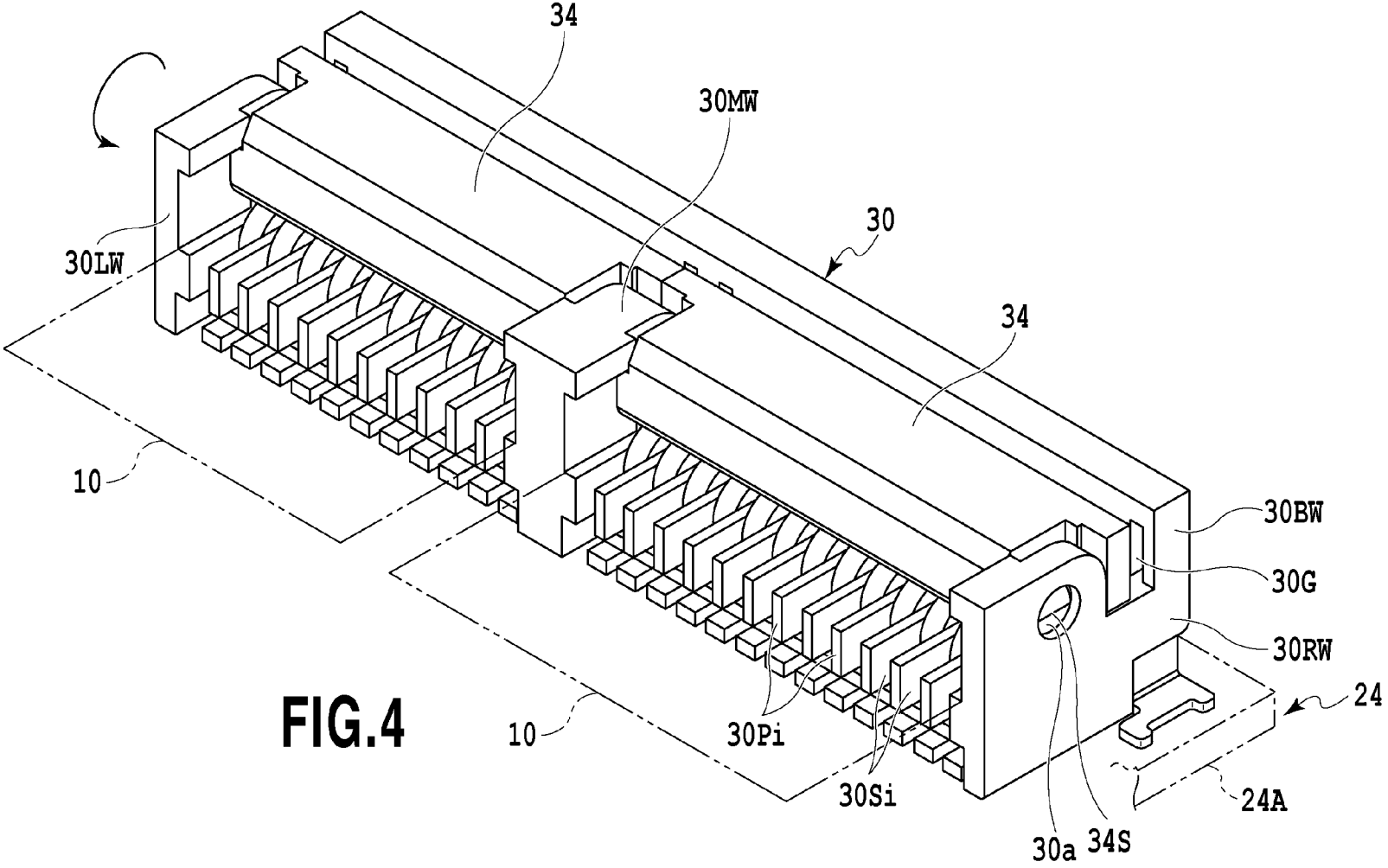
FIG. 4 is a perspective view showing external appearance of an example of the cable connector according to the present invention.

As shown in FIG. 2 and FIG. 4, connection end portions 15 of two flexible boards 10, for example, are to be connected to the cable connector 30, respectively. The cable connector 30 is fixed to an end portion of the mounting surface of the first board 24A. The cable connector 30 includes, as its main elements: a pair of cable end portion accommodating portions 30A into which the connection end portions 15 on one side of the flexible boards 10 are detachably inserted, respectively; the contact terminals 32*ai* (see FIG. 5) configured to electrically connect the connection end portions 15 on the one side of the flexible boards 10 to the plurality of signal layers 24S and the plurality of ground layers 24G of the first board 24A; and a pair of lever members 34 configured to press the connection end portions on the one side of the flexible boards 10, which are inserted into the cable end portion accommodating portions 30A, against contact portions of the plurality of contact terminals 32*ai* and to hold the connection end portions 15 thereon.

One of the pair of cable end portion accommodating portions 30A is formed by being surrounded by a side wall 30RW, a middle wall 30MW, a back wall 30BW, and a bottom wall, which collectively constitute a housing. The other cable end portion accommodating portion 30A is formed by being surrounded by a side wall 30LW, the middle wall 30MW, the aforementioned back wall 30BW, and the aforementioned bottom wall, which collectively constitute a housing. Each cable end portion accommodating portion 30A has a cable insertion slot which is opened in a direction of extension of the printed circuit board 24. Each cable end portion accommodating portion 30A includes a plurality of slits 30Si (i=1 to n, n is the positive integer) in which the contact terminals 32*ai* are arranged. The plurality of slits 30Si are formed at given intervals along the Y coordinate axis in FIG. 2. The slits 30Si penetrate the back wall 30BW as shown in FIG. 3. Every adjacent slits 30Si are separated from each other by a corresponding one of partition walls 30Pi (i=1 to n, n is the positive integer).

The lever members 34 serving as cable holding means are turnably provided above the cable end portion accommodating portions 30A, respectively. Support shafts 34S formed on two ends of one of the lever members 34, respectively, are inserted into a hole 30*a* in the side wall 30RW and a hole (not shown) in the middle wall 30MW. Support shafts 34S formed on two ends of the other lever member 34, respectively, are inserted into a hole 30*a* in the side wall 30LW and the hole (not shown) in the middle wall 30MW. In the case where the flexible board 10 is attached to the cable connector 30 having the above-described configuration, the area of an opening of the cable insertion slot becomes largest when each lever member 34 is turned in a direction indicated with an arrow in FIG. 4. Hence, the connection end portion 15 on the one side of the flexible board 10 is inserted into the insertion slot. Thereafter, the lever member 34 is turned in a direction opposite to the direction indicated with the arrow in FIG. 4 until tabs of the lever member 34 are inserted into a groove 30G in the side wall 30RW or 30LW and into a groove 30G in the middle wall 30MW. Thus, a pressing surface of the lever member 34 presses the connection end portion 15 on the one side of the flexible board 10 against contact portions 32C of the plurality of contact terminals 32*ai*, and the contact end portion 15 is held in the corresponding cable end portion accommodating portion 30A (see FIG. 3).

As shown in FIG. 3, the contact terminals 32*ai* are made of a thin-plate metal material, for example, and include: the contact portions 32C to come into contact with contact pads (hereinafter also referred to as conductive layers) 22*ai* (i=1 to n, n is the positive integer) of the connection end portion on the one side of the flexible board 10; the fixed terminal portions 32F to be soldered and fixed to the end portions of the plurality of signal layers 24S and the plurality of ground layers 24G of the first board 24A; and movable pieces 32M to couple the contact portions 32C to the fixed terminal portions 32F.

Each contact portion 32C is bent into an arc shape such that its tip end is directed to the fixed terminal portion 32F. The fixed terminal portion 32F projects from an open end portion of the slit 30Si that is adjacent to the cable insertion slot toward the first board 24A. As shown in FIG. 3, the movable piece 32M extends to the back wall 30BW and is bent substantially into a U-shape.

Figure 1:
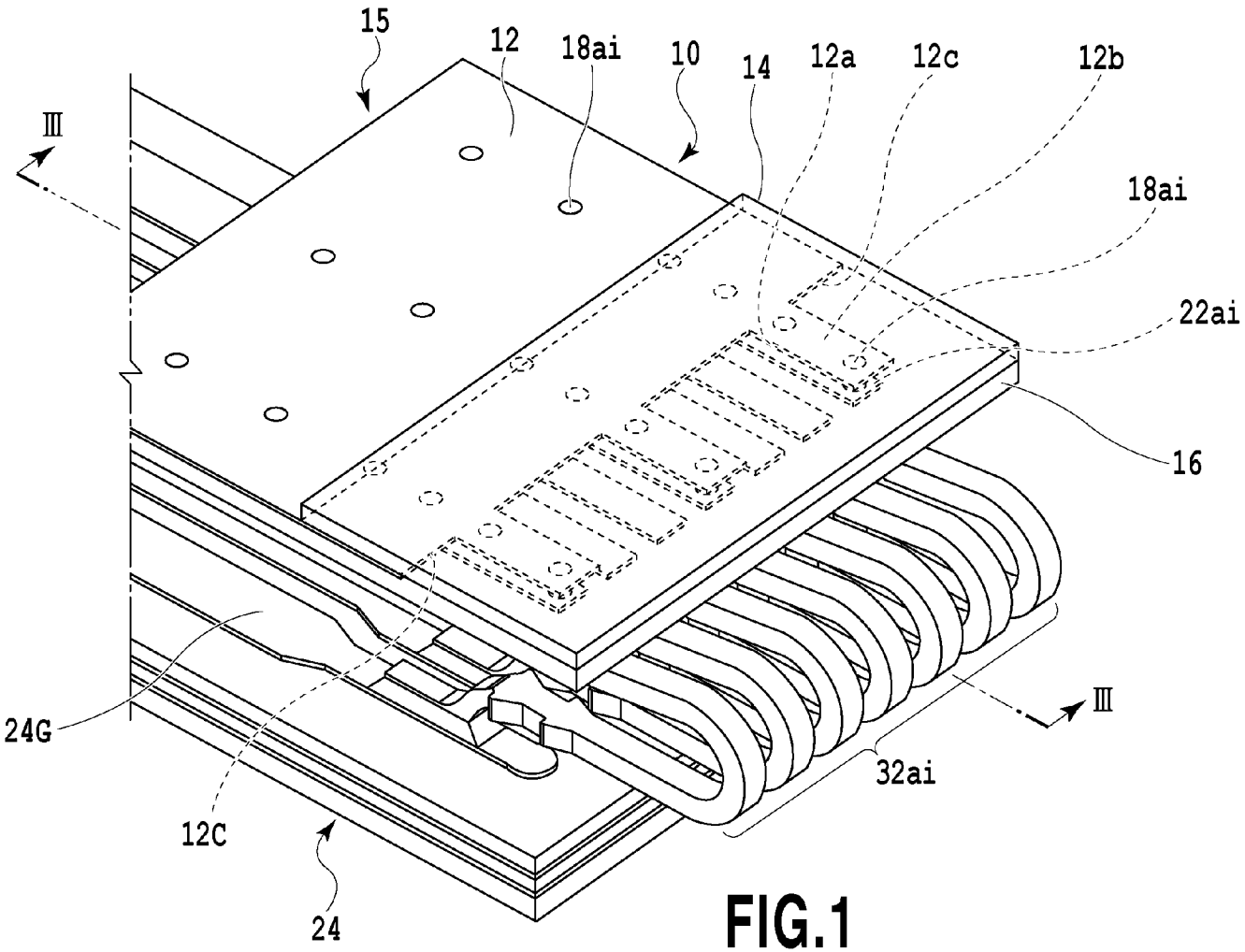
FIG. 1 is a perspective view showing a first embodiment of a cable connection structure according to the present invention together with substantial part of a cable connector.

As shown in FIG. 1 and FIG. 3, the flexible board 10 has a configuration in which a conductive body 20 including a plurality of conductive layers 22*ai* (i=1 to n, n is the positive integer) each covered with a protection layer, for example, is formed on a surface 16B of an insulative base material 16 opposed to the contact portions 32C of the contact terminals 32*ai*. The protection layer is made of a thermosetting resist layer or a polyimide film, for example. The insulative base material 16 is molded of a liquid crystal polymer, polyimide (PI), polyethylene terephthalate (PET), or polyetherimide (PEI), for example. In addition, each conductive layer 22*ai* is formed from layers of a copper alloy, for example. A contact pad is formed at a section at one end of each conductive layer 22*ai* corresponding to the connection end portion of the flexible board 10, the section being designed to come into contact with the contact portion 32C of the contact terminal 32*ai*. The conductive layers 22*ai* include a ground line conductive layer (G), a signal line conductive layer (S), another signal line conductive layer (S), another ground line conductive layer (G), and so forth which are arranged sequentially from one end in FIG. 1.

As shown in an enlarged manner in FIG. 1, a ground plate 12 having a predetermined length is fixed to a surface 16A of the insulative base material 16 located opposite from the surface 16B. Extension portions 12*b* are formed like teeth of a comb, respectively, at portions of the ground plate 12 which are located immediately above contact pads of the above-described ground line conductive layers (G). The ground line conductive layers (G) out of the conductive layers 22*ai* and the extension portions 12*b* are electrically connected to one another through vias 18*ai* (i=1 to n, n is the positive integer).

A clearance 12*a* is formed between every two extension portions 12*b* that are adjacent to each other at a given interval. Two signal line conductive layers (S) out of the conductive layers 22*ai* are formed at a position immediately below each clearance 12*a* of the ground plate 12. Moreover, in FIG. 1, a cutout portion 12*c* is formed adjacent to each endmost extension portion 12*b* of the ground plate 12.

A rectangular reinforcing plate 14 molded of a conductive resin material, for example, is fixed to part of an upper surface of the ground plate 12. Electric conductivity (conductance) of the conductive resin material being an antistatic resin material is set in a range from 1 S/m to 30000 S/m inclusive, for example.

An end surface at one end of the reinforcing plate 14 and an end surface at one end of the insulative base material 16 are located on a common plane. Accordingly, the extension portions 12*b* of the ground plate 12 is set to the same electric potential as that of the ground line conductive layers (G). Note that the reinforcing plate 14 is not limited to the above-described example, and may be formed by cutting the conductive resin material, for instance. The reinforcing plate 14 may be molded of a glass epoxy, polyimide, polyethylene terephthalate materials or the like.

When the flexible board 10 is connected to the cable connector 30 in the above-described configuration, the lever member 34 is turned in the direction indicated with the arrow in FIG. 4, and the connection end portion on the one side of the flexible board 10 is inserted through the cable insertion slot and located at a predetermined position. Then, the lever member 34 is turned in the direction opposite to the direction indicated with the arrow in FIG. 4 until the tabs of the lever member 34 are inserted into the grooves 30G. Thus, the pressing surface of the lever member 34 presses the connection end portion on the one side of the flexible board 10 against the contact portions 32C of the plurality of contact terminals 32*ai*, and the contact end portion is held thereon. On the other hand, when the flexible board 10 is detached from the cable connector 30, the lever member 34 is turned in the direction indicated with the arrow in FIG. 4, and the connection end portion on the one side of the flexible board 10 is pulled out and thus detached from the cable connector 30.

Accordingly, in the above-described configuration, the connection end portion on the one side of the flexible board 10 can be electrically connected to the printed circuit board 24 without requiring any soldering work. Thus, it is possible to stabilize work quality in connecting the connection end portion of the flexible board to the circuit board. In addition, the extension portions 12*b* of the ground plate 12 are set to the same electric potential as that of the ground line conductive layers (G). Thus, it is possible to maintain high quality in signal characteristics of a transceiver module when a communication speed in the transceiver module becomes relatively high.

Figure 5:
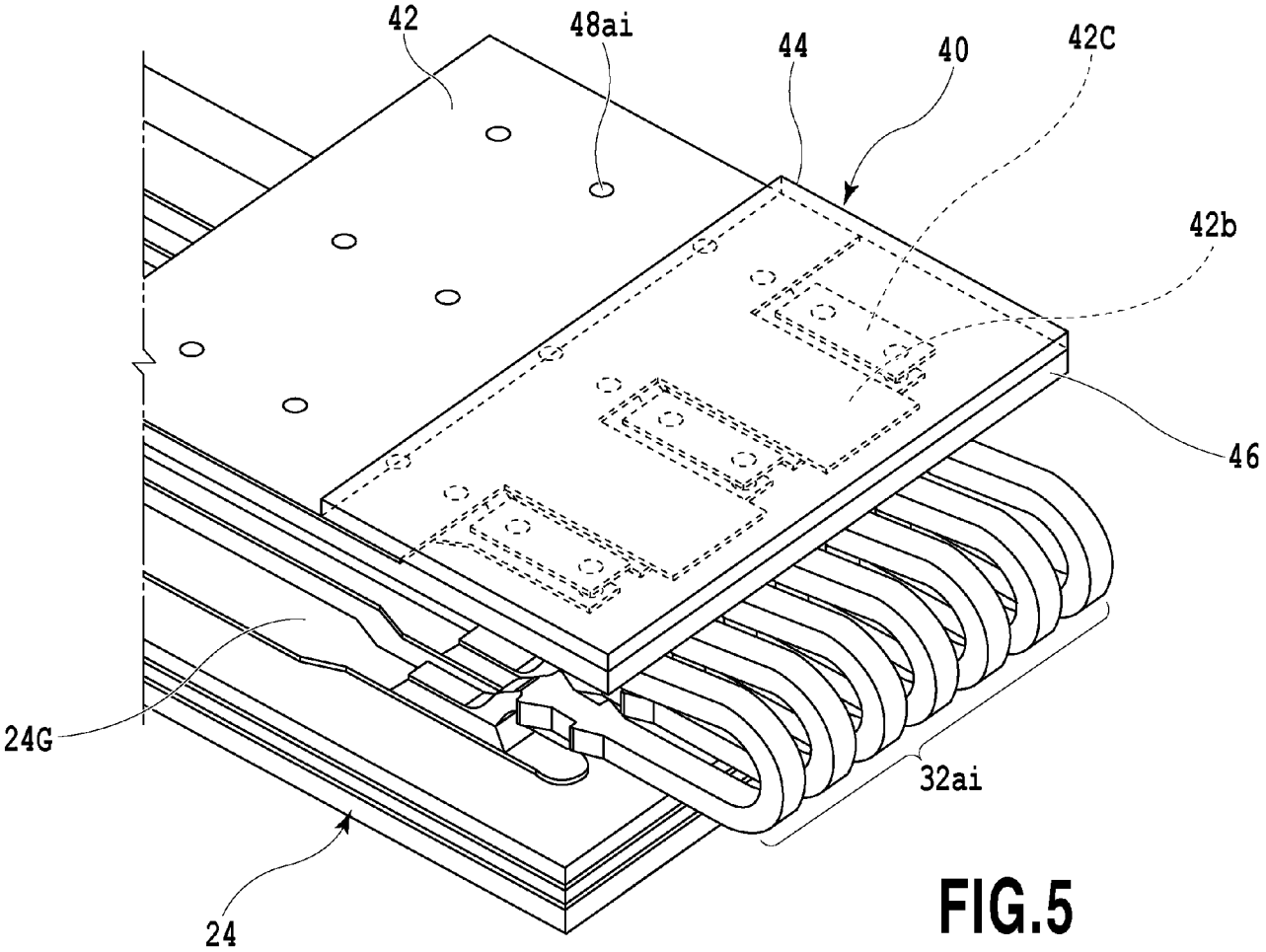
FIG. 5 is a perspective view showing a second embodiment of a cable connection structure according to the present invention together with substantial part of a cable connector.

FIG. 5 shows substantial part of a cable connector, to which a cable connection structure according to a second embodiment of the present invention is applied, together with the printed circuit board.

In the example shown in FIG. 1, the clearance 12*a* is formed between every two extension portions 12*b* of the ground plate 12 which are adjacent to each other at a given interval. On the other hand, in an example shown in FIG. 5, a ground plate piece 42C is additionally provided between extension portions 42*b* of a ground plate 42 of a flexible board 40. A cable connector has a configuration similar to that of the cable connector 30 shown in FIG. 4.

Note that constituents in FIG. 5 which are the same as the constituents in the example shown in FIG. 1 will be designated by the same reference numerals and overlapping description thereof will be omitted.

As shown in FIG. 5, the flexible board 40 has a configuration in which a conductive body including a plurality of conductive layers each covered with a protection layer, for example, is formed on a surface of an insulative base material 46 opposed to the contact portions 32C of the contact terminals 32*ai*. The protection layer is made of a thermosetting resist layer or a polyimide film, for example. The insulative base material 46 is molded of a liquid crystal polymer, polyimide (PI), polyethylene terephthalate (PET), or polyetherimide (PEI), for example. In addition, each of the above-described conductive layers is formed from layers of a copper alloy, for example. A contact pad is formed at a section at one end of each conductive layer corresponding to a connection end portion of the flexible board 40, the section being designed to come into contact with the contact portion 32C of the contact terminal 32*ai*. The conductive layers include a ground line conductive layer (G), a signal line conductive layer (S), another signal line conductive layer (S), another ground line conductive layer (G), and so forth which are arranged sequentially from one end.

A ground plate 42 having a predetermined length is fixed to a surface of the insulative base material 46 located opposite from the aforementioned surface. The substantially rectangular ground plate pieces 42C are provided at given intervals on a common plane, respectively, at portions of the ground plate 42 which are located immediately above contact pads of the above-described ground line conductive layers (G). In addition, extension portions 42*b* extending from an end of the ground plate 42 to an end of the insulative base material 46 are formed at given intervals like teeth of a comb at spaces between the adjacent ground plate pieces 42C. The ground line conductive layers (G) out of the conductive layers, the ground plate pieces 42C, and the ground plate 42 are electrically connected to one another through vias 48*ai*.

Two signal line conductive layers (S) out of the conductive layers are formed at a position immediately below each extension portion 42*b* of the ground plate 42.

A rectangular reinforcing plate 44 molded of a conductive resin material, for example, is fixed to part of an upper surface of the ground plate 42. Electric conductivity of the conductive resin material being an antistatic resin material is set in a range from 1 S/m to 30000 S/m inclusive, for example. An end surface at one end of the reinforcing plate 44 and an end surface at one end of the insulative base material 46 are located on a common plane. Accordingly, the extension portions 42*b* of the ground plate 42 and the ground plate pieces 42C are set to the same electric potential as that of the ground line conductive layers (G). Note that the reinforcing plate 44 is not limited to the above-described example, and may be formed by cutting the conductive resin material, for instance. The reinforcing plate 44 may be molded of a glass epoxy, polyimide, polyethylene terephthalate materials or the like.

Accordingly, in the above-described configuration as well, the connection end portion on the one side of the flexible board 40 can be electrically connected to the printed circuit board 24 without requiring any soldering work. Thus, it is possible to stabilize work quality in connecting the connection end portion of the flexible board to the circuit board. In addition, the extension portions 42*b* of the ground plate 42 and the ground plate pieces 42C are set to the same electric potential as that of the ground line conductive layers (G). Thus, it is possible to maintain high quality in signal characteristics of a transceiver module when a communication speed in the transceiver module becomes relatively high.

Figure 6:
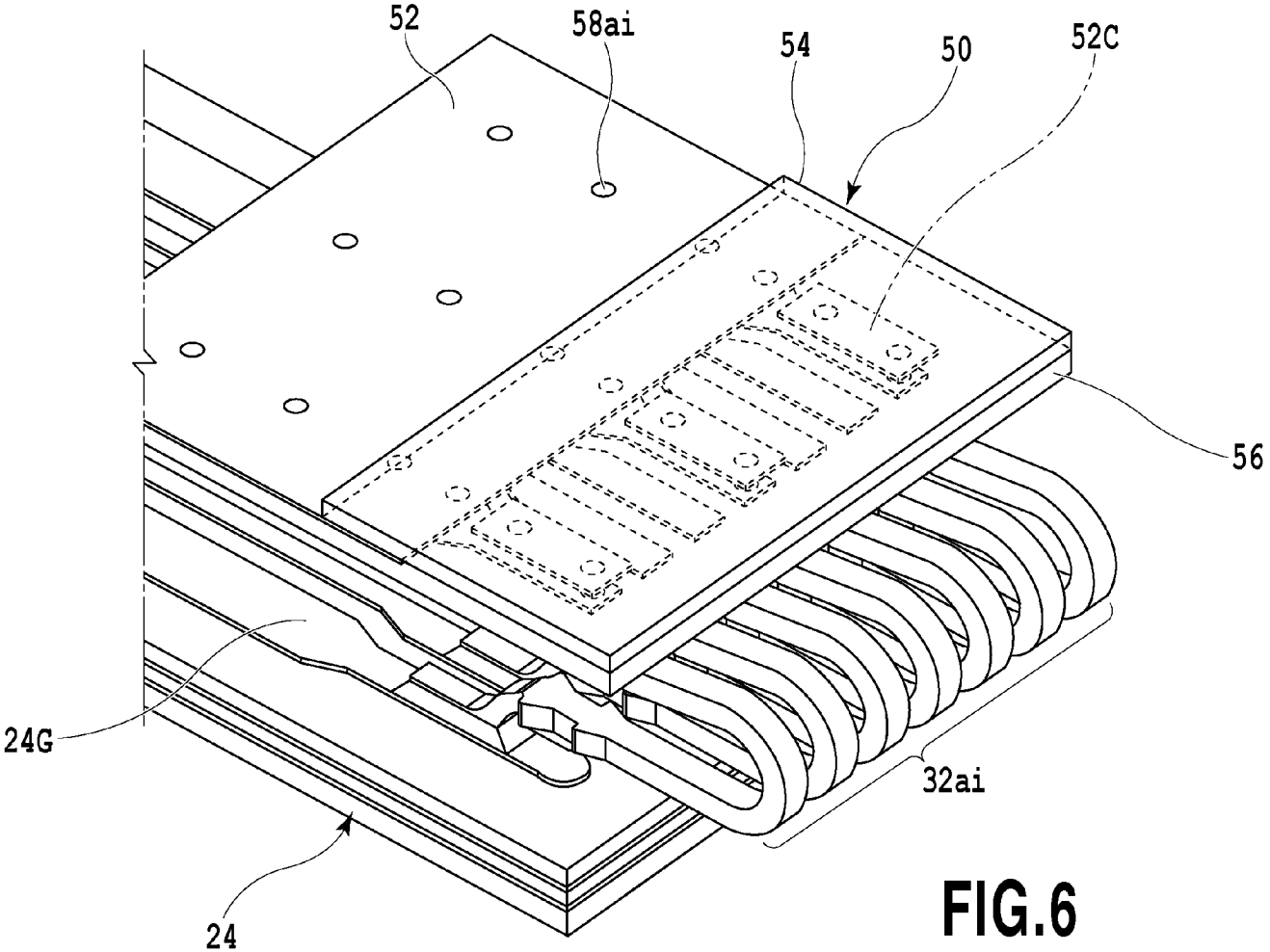
FIG. 6 is a perspective view showing a third embodiment of a cable connection structure according to the present invention together with substantial part of a cable connector.

FIG. 6 shows substantial part of a cable connector, to which a cable connection structure according to a third embodiment of the present invention is applied, together with the printed circuit board.

In the example shown in FIG. 1, the extension portions 12*b* of the ground plate 12 of the flexible board 10, which are adjacent at the given intervals, are formed integrally with the remaining portion of the ground plate 12. On the other hand, in an example shown in FIG. 6, ground plate pieces 52C are provided on a common plane, respectively, at portions of a ground plate 52 of a flexible board 50 which are located immediately above contact pads of ground line conductive layers (G), while having a given interval with the ground plate 52.

A cable connector has a configuration similar to that of the cable connector 30 shown in FIG. 4.

Note that constituents in FIG. 6 which are the same as the constituents in the example shown in FIG. 1 will be designated by the same reference numerals and overlapping description thereof will be omitted.

As shown in FIG. 6, the flexible board 50 has a configuration in which a conductive body including conductive layers each covered with a protection layer, for example, is formed on a surface of an insulative base material 56 opposed to the contact portions 32C of the contact terminals 32*ai*. The protection layer is made of a thermosetting resist layer or a polyimide film, for example. The insulative base material 56 is molded of a liquid crystal polymer, polyimide (PI), polyethylene terephthalate (PET), or polyetherimide (PEI), for example. In addition, each of the above-described conductive layers is formed from layers of a copper alloy, for example. A contact pad is formed at a section at one end of each conductive layer corresponding to a connection end portion of the flexible board 50, the section being designed to come into contact with the contact portion 32C of the contact terminal 32*ai*. The conductive layers include a ground line conductive layer (G), a signal line conductive layer (S), another signal line conductive layer (S), another ground line conductive layer (G), and so forth which are arranged sequentially from one end.

The ground plate 52 having a predetermined length is fixed to a surface of the insulative base material 56 located opposite from the aforementioned surface. The substantially rectangular ground plate pieces 52C are provided at given intervals on a common plane, respectively, at portions which are located away from an end of the ground plate 52 by the given interval and immediately above contact pads of the above-described ground line conductive layers (G). The ground line conductive layers (G) out of the conductive layers, the ground plate pieces 52C, and the ground plate 52 are electrically connected to one another through vias 58*ai* (i=1 to n, n is the positive integer).

Two signal line conductive layers (S) out of the conductive layers are formed at a position immediately below each space between the ground plate pieces 52C.

A rectangular reinforcing plate 54 molded of a conductive resin material, for example, is fixed to part of an upper surface of the ground plate 52. Electric conductivity of the conductive resin material being an antistatic resin material is set in a range from 1 S/m to 30000 S/m inclusive, for example. An end surface at one end of the reinforcing plate 54 and an end surface at one end of the insulative base material 56 are located on a common plane. Accordingly, the ground plate 52 and the ground plate pieces 52C are set to the same electric potential as that of the ground line conductive layers (G). Note that the reinforcing plate 54 is not limited to the above-described example, and may be formed by cutting the conductive resin material, for instance.

The reinforcing plate 54 may be molded of a glass epoxy, polyimide, polyethylene terephthalate materials or the like.

Accordingly, in the above-described configuration as well, the connection end portion on the one side of the flexible board 50 can be electrically connected to the printed circuit board 24 without requiring any soldering work. Thus, it is possible to stabilize work quality in connecting the connection end portion of the flexible board to the circuit board. In addition, the ground plate 52 and the ground plate pieces 52C are set to the same electric potential as that of the ground line conductive layers (G). Thus, it is possible to maintain high quality in signal characteristics of a transceiver module when a communication speed in the transceiver module becomes relatively high.

Figure 7:
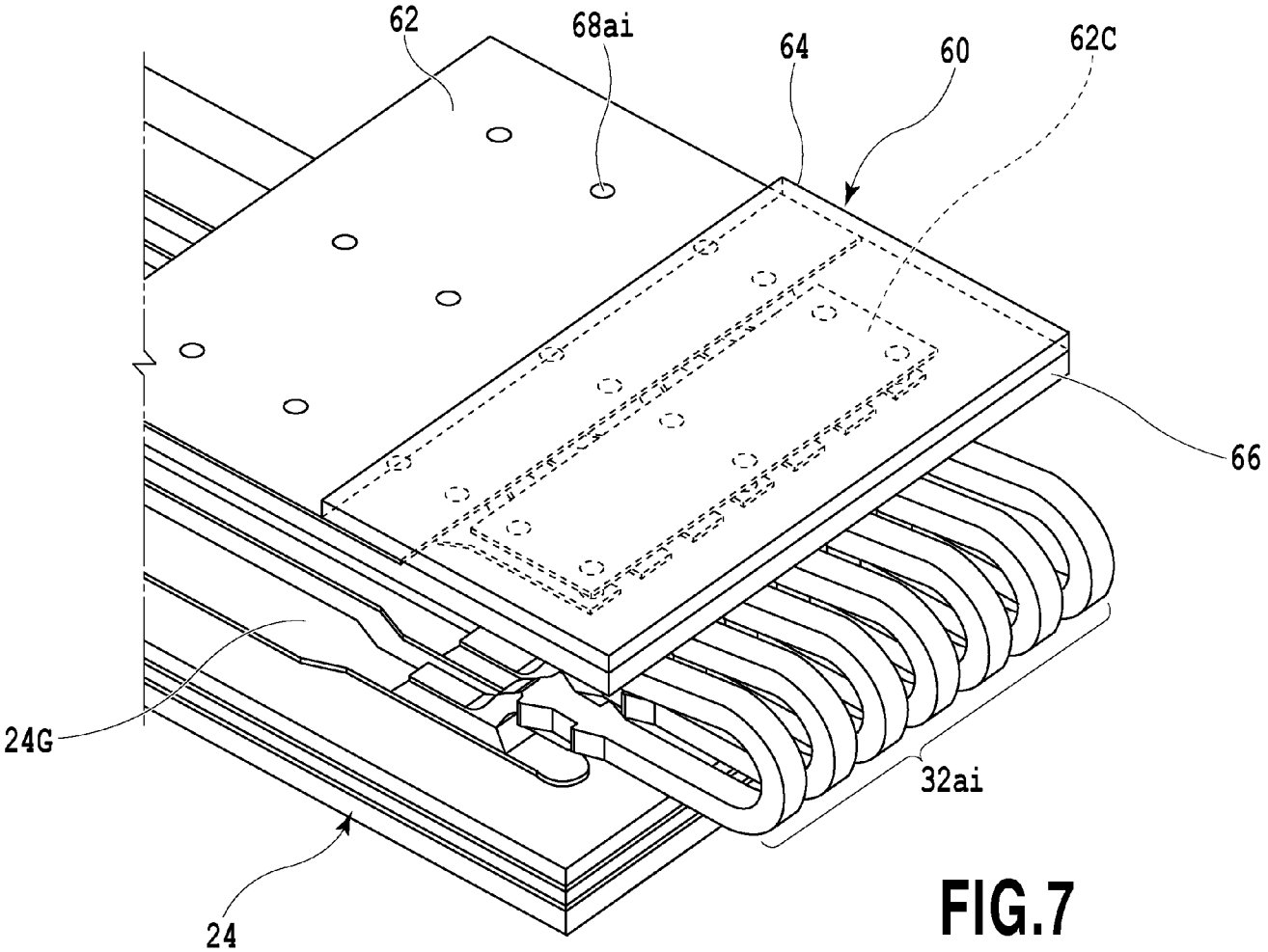
FIG. 7 is a perspective view showing a fourth embodiment of a cable connection structure according to the present invention together with substantial part of a cable connector.

FIG. 7 shows substantial part of a cable connector, to which a cable connection structure according to a fourth embodiment of the present invention is applied, together with the printed circuit board.

In the example shown in FIG. 1, the plurality of extension portions 12*b* of the ground plate 12 of the flexible board 10 are formed at the given intervals. On the other hand, in an example shown in FIG. 7, a second ground plate 62C extending along the arrangement of the contact terminals 32*ai* is formed on a common plane while having a given interval with a first ground plate 62 of a flexible board 60.

A cable connector has a configuration similar to that of the cable connector 30 shown in FIG. 4.

Note that constituents in FIG. 7 which are the same as the constituents in the example shown in FIG. 1 will be designated by the same reference numerals and overlapping description thereof will be omitted.

As shown in FIG. 7, the flexible board 60 has a configuration in which a conductive body including conductive layers each covered with a protection layer, for example, is formed on a surface of an insulative base material 66 opposed to the contact portions 32C of the contact terminals 32*ai*. The protection layer is made of a thermosetting resist layer or a polyimide film, for example. The insulative base material 66 is molded of a liquid crystal polymer, polyimide (PI), polyethylene terephthalate (PET), or polyetherimide (PEI), for example. In addition, each of the above-described conductive layers is formed from layers of a copper alloy, for example. A contact pad is formed at a section at one end of each conductive layer corresponding to a connection end portion of the flexible board 60, the section being designed to come into contact with the contact portion 32C of the contact terminal 32*ai*. The conductive layers include a ground line conductive layer (G), a signal line conductive layer (S), another signal line conductive layer (S), another ground line conductive layer (G), and so forth which are arranged sequentially from one end.

The first ground plate 62 having a predetermined length is fixed to a surface of the insulative base material 66 located opposite from the aforementioned surface. The substantially rectangular second ground plate 62C extending in the direction of the arrangement of the ground line conductive layers (G) and the signal line conductive layers (S) described above is provided on a common plane at a position away from an end of the first ground plate 62 by the given interval. A length dimension and a width dimension of the second ground plate 62C in terms of the direction of arrangement of the ground line conductive layers (G) and the signal line conductive layers (S) described above are set smaller than a length dimension and a width dimension of the first ground plate 62.

The ground line conductive layers (G) out of the conductive layers, the first ground plate 62, and the second ground plate 62C of the flexible board 60 are electrically connected to one another through vias 68*ai* (i=1 to n, n is the positive integer).

A rectangular reinforcing plate 64 molded of a conductive resin material, for example, is fixed to part of an upper surface of the first ground plate 52 and to an upper surface of the second ground plate 62C. Electric conductivity of the conductive resin material being an antistatic resin material is set in a range from 1 S/m to 30000 S/m inclusive, for example. An end surface at one end of the reinforcing plate 64 and an end surface at one end of the insulative base material 66 are located on a common plane. Accordingly, the first ground plate 62 and the second ground plate 62C are set to the same electric potential as that of the ground line conductive layers (G). Note that the reinforcing plate 64 is not limited to the above-described example, and may be formed by cutting the conductive resin material, for instance. The reinforcing plate 64 may be molded of a glass epoxy, polyimide, polyethylene terephthalate materials or the like.

Accordingly, in the above-described configuration as well, the connection end portion on the one side of the flexible board 60 can be electrically connected to the printed circuit board 24 without requiring any soldering work. Thus, it is possible to stabilize work quality in connecting the connection end portion of the flexible board to the circuit board. In addition, the first ground plate 62 and the second ground plate 62C are set to the same electric potential as that of the ground line conductive layers (G). Thus, it is possible to maintain high quality in signal characteristics of a transceiver module when a communication speed in the transceiver module becomes relatively high.

Figure 8:
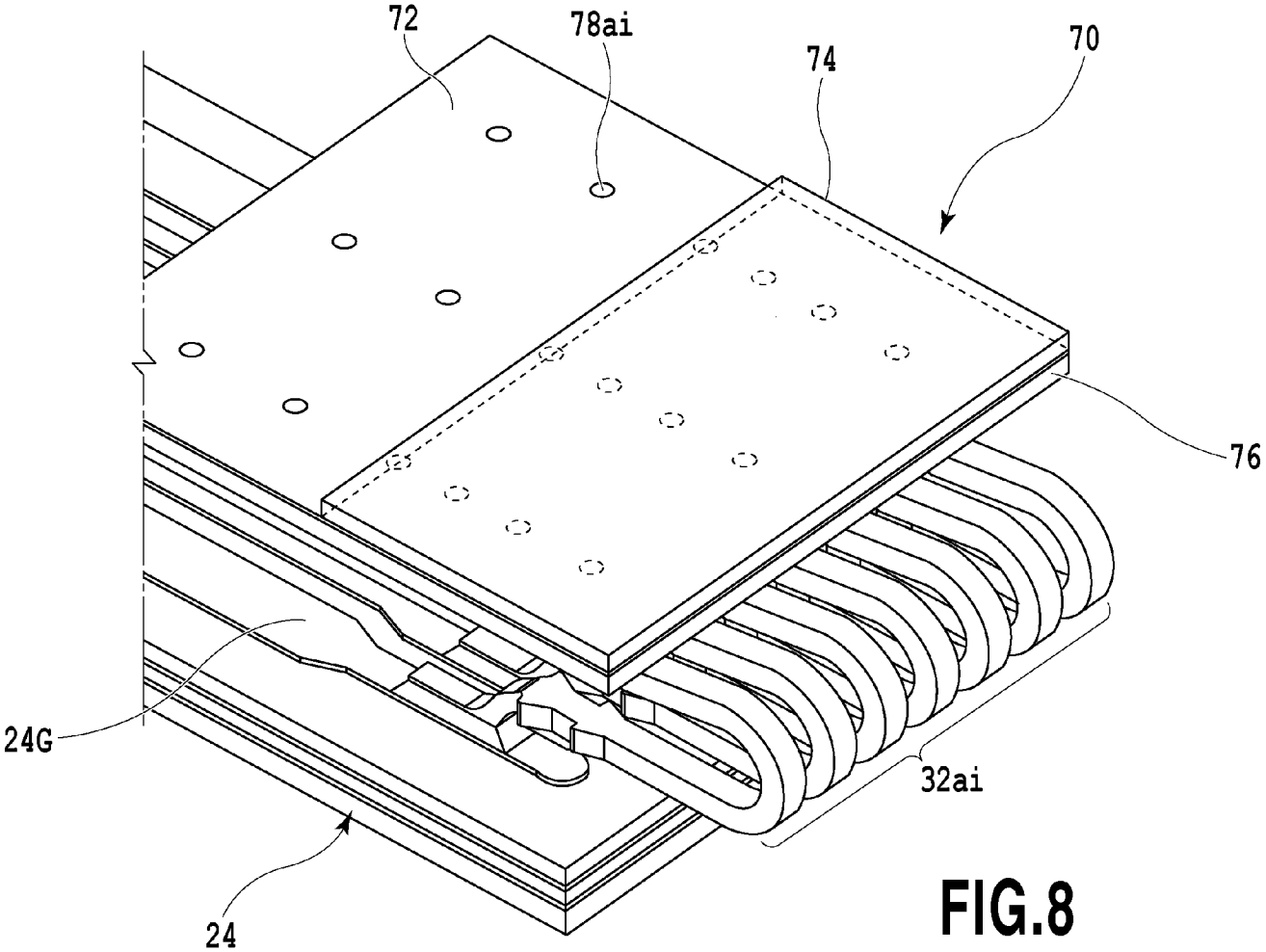
FIG. 8 is a perspective view showing a fifth embodiment of a cable connection structure according to the present invention together with substantial part of a cable connector.

FIG. 8 shows substantial part of a cable connector, to which a cable connection structure according to a fifth embodiment of the present invention is applied, together with the printed circuit board.

In the example shown in FIG. 1, the plurality of extension portions 12*b* of the ground plate 12 of the flexible board 10 are formed to the extent that the tip ends thereof do not reach the end surface of the insulative base material 16. On the other hand, in an example shown in FIG. 8, a ground plate 72 is provided on the entire surface at an end portion of an insulative base material 76 corresponding to a connection end portion of a flexible board 70.

A cable connector has a configuration similar to that of the cable connector 30 shown in FIG. 4.

Note that constituents in FIG. 8 which are the same as the constituents in the example shown in FIG. 1 will be designated by the same reference numerals and overlapping description thereof will be omitted.

As shown in FIG. 8, the flexible board 70 has a configuration in which a conductive body including a plurality of conductive layers each covered with a protection layer, for example, is formed on a surface of the insulative base material 76 opposed to the contact portions 32C of the contact terminals 32*ai*. The protection layer is made of a thermosetting resist layer or a polyimide film, for example. The insulative base material 76 is molded of a liquid crystal polymer, polyimide (PI), polyethylene terephthalate (PET), or polyetherimide (PEI), for example. In addition, each of the above-described conductive layers is formed from layers of a copper alloy, for example. A contact pad is formed at a section at one end of each conductive layer corresponding to a connection end portion of the flexible board 70, the section being designed to come into contact with the contact portion 32C of the contact terminal 32*ai*. The conductive layers include a ground line conductive layer (G), a signal line conductive layer (S), another signal line conductive layer (S), another ground line conductive layer (G), and so forth which are arranged sequentially from one end.

The ground plate 72 having a predetermined length is fixed to a surface of the insulative base material 76 located opposite from the aforementioned surface. As shown in FIG. 8, the ground plate 72 extends to the end portion on one side of the insulative base material 76.

The ground line conductive layers (G) out of the conductive layers, and ground plate 72 of the flexible board 70 are electrically connected to one another through vias 78*ai* (i=1 to n, n is the positive integer).

As shown in FIG. 8, a rectangular reinforcing plate 74 molded of a conductive resin material, for example, is fixed to part of an upper surface of the ground plate 72. Electric conductivity of the conductive resin material being an antistatic resin material is set in a range from 1 S/m to 30000 S/m inclusive, for example. An end surface at one end of the reinforcing plate 74 and an end surface at one end of the insulative base material 76 are located on a common plane. Accordingly, the ground plate 72 and the ground line contact terminals 32*ai* are set to the same electric potential as that of the ground line conductive layers (G). Note that the reinforcing plate 74 is not limited to the above-described example, and may be formed by cutting the conductive resin material, for instance. The reinforcing plate 74 may be molded of a glass epoxy, polyimide, polyethylene terephthalate materials or the like.

Accordingly, in the above-described configuration as well, the connection end portion on the one side of the flexible board 70 can be electrically connected to the printed circuit board 24 without requiring any soldering work. Thus, it is possible to stabilize work quality in connecting the connection end portion of the flexible board to the circuit board. In addition, the ground plate 72 and the ground line contact terminals 32*ai* are set to the same electric potential as that of the ground line conductive layers (G). Thus, it is possible to maintain high quality in signal characteristics of a transceiver module when a communication speed in the transceiver module becomes relatively high.

The inventor of the present application has conducted comparative verification concerning characteristics of insertion losses and crosstalk in the cable connection structures according to the above-described first to fifth embodiments of the present invention by use of a given simulator system.

Figure 9:
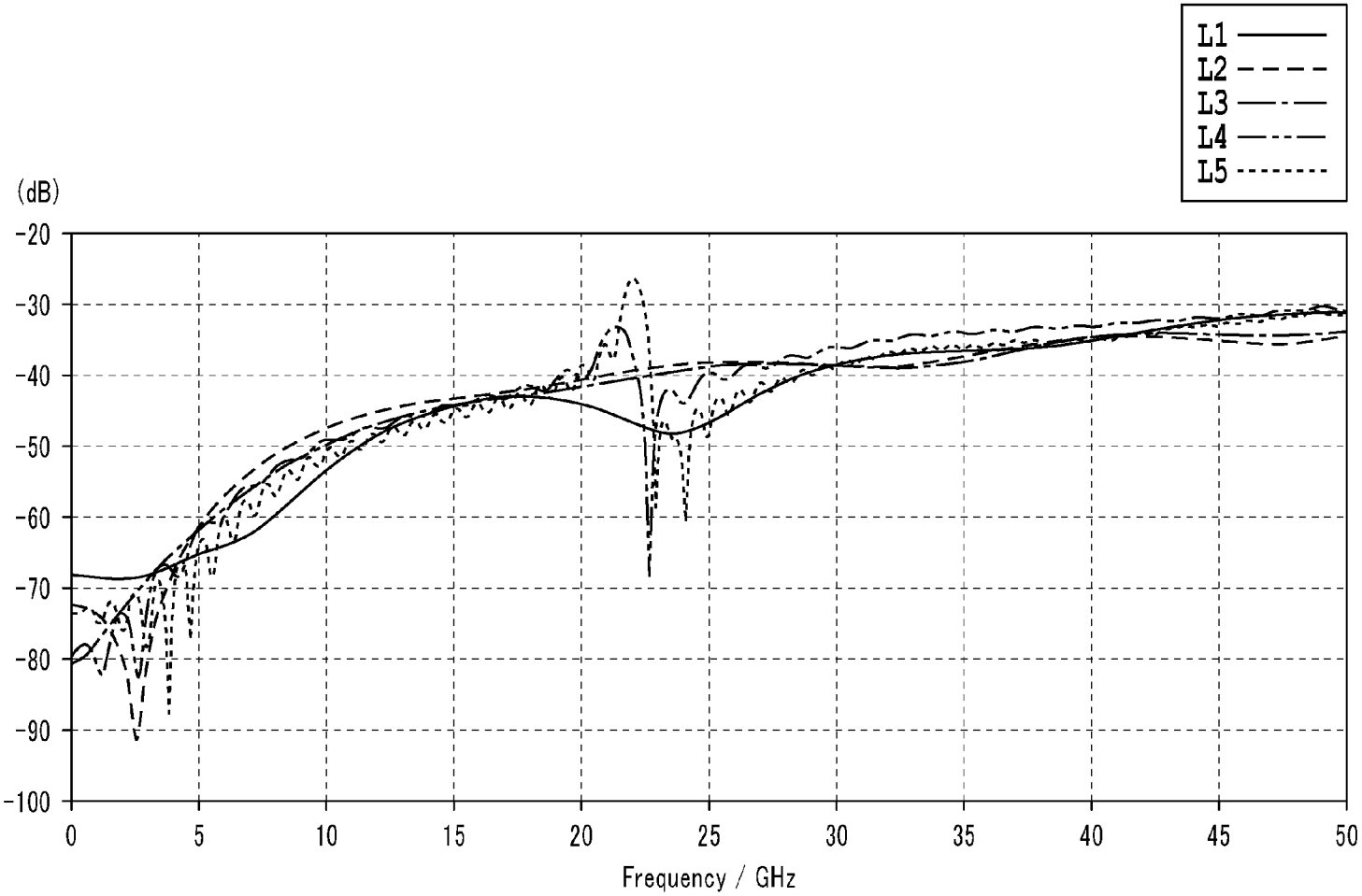
FIG. 9 is a characteristic diagram showing characteristic lines which represent characteristics of crosstalk in each embodiment of the cable connection structures according to the present invention.

FIG. 9 represents characteristics of crosstalk (far-end crosstalk) when a given signal is transmitted from the respective flexible boards described above, in which the vertical axis indicates the crosstalk (dB) and the horizontal axis indicates the frequency (GHz). Characteristic lines L1, L2, L3, L4, and L5 show characteristics of crosstalk of the second embodiment (see FIG. 5), the third embodiment (see FIG. 6), the first embodiment (see FIG. 1), the fourth embodiment (see FIG. 7), and the fifth embodiment (see FIG. 8), respectively.

As apparent from the characteristic lines L1, L2, and L3 in FIG. 9, in a frequency range of 20 GHz to 25 GHz, for example, stable and fine characteristic results with no ripples were achieved in the order of the characteristic lines L1 (the second embodiment), L3 (the first embodiment), and L2 (the third embodiment).

Figure 10:
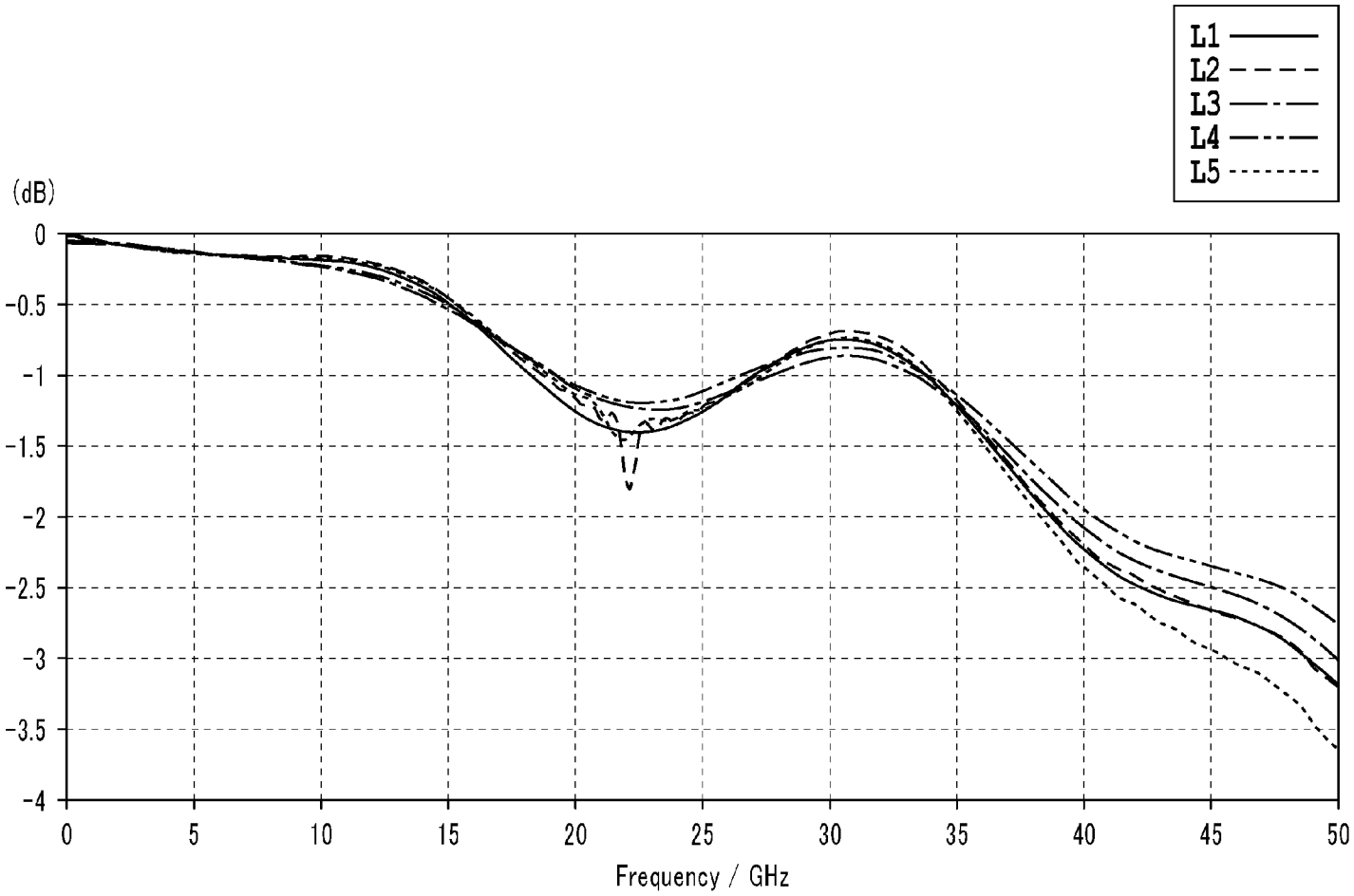
FIG. 10 is a characteristic diagram showing characteristic lines which represent characteristics of insertion losses in each embodiment of the cable connection structures according to the present invention.

FIG. 10 represents characteristics of insertion losses when a given signal is transmitted from the respective flexible boards described above, in which the vertical axis indicates the insertion loss (dB) and the horizontal axis indicates the frequency (GHz). Characteristic lines L1, L2, L3, L4, and L5 show characteristics of insertion losses of the second embodiment (see FIG. 5), the third embodiment (see FIG. 6), the first embodiment (see FIG. 1), the fourth embodiment (see FIG. 7), and the fifth embodiment (see FIG. 8), respectively.

As apparent from the characteristic lines L1, L2, and L3 in FIG. 10, in the frequency range of 20 GHz to 25 GHz, for example, stable and fine characteristic results with no ripples were achieved in the order of the characteristic lines L3 (the first embodiment), L2 (the third embodiment), and L1 (the second embodiment).

Figure 11:
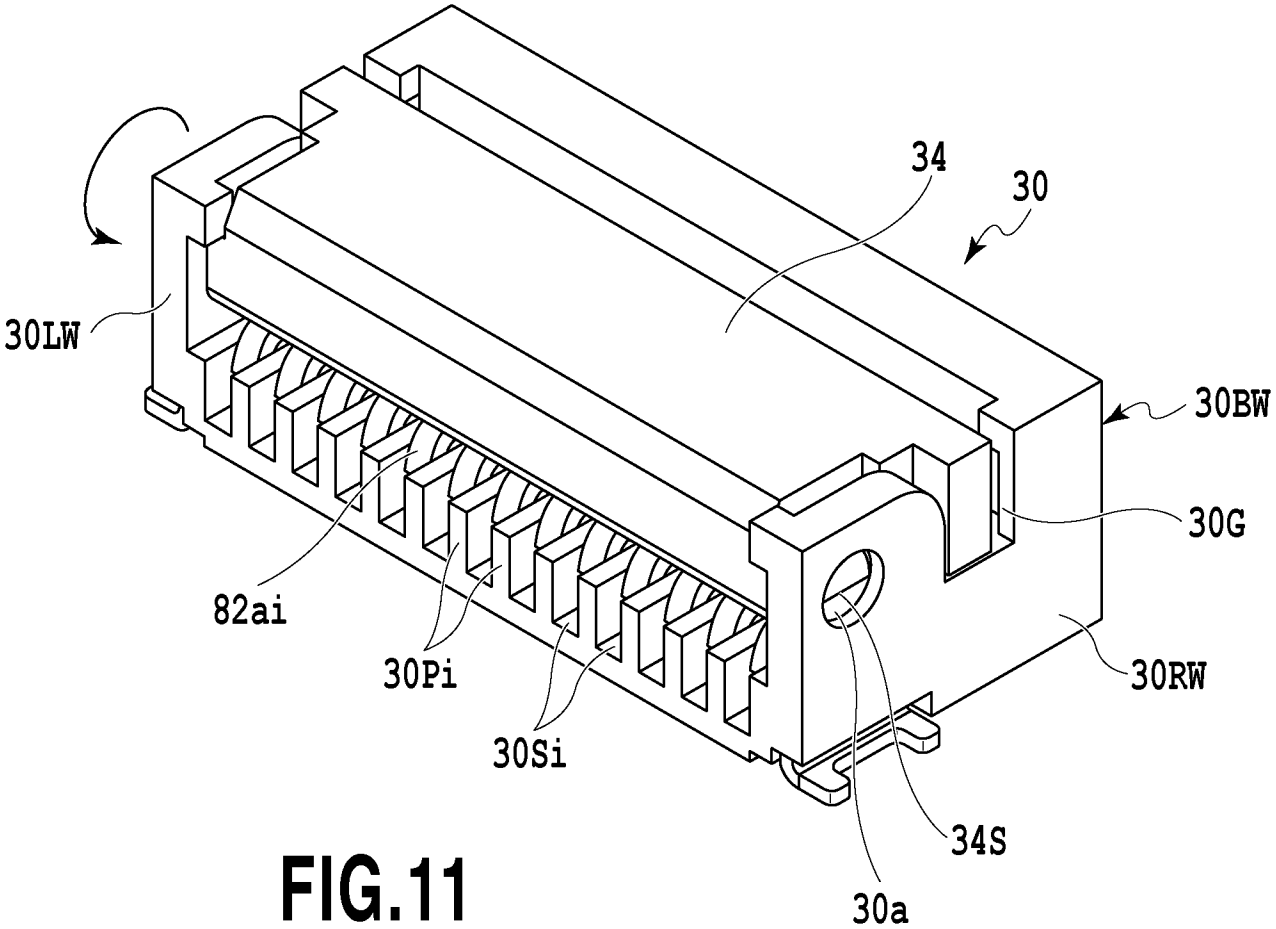
FIG. 11 is a perspective view showing external appearance of an example of the cable connector using another example of contact terminals and being applied in each embodiment of the cable connection structures according to the present invention.

FIG. 11 shows external appearance of another example of the cable connector to which the above-described cable connection structures according to the embodiments of the present invention are applied.

Figure 14:
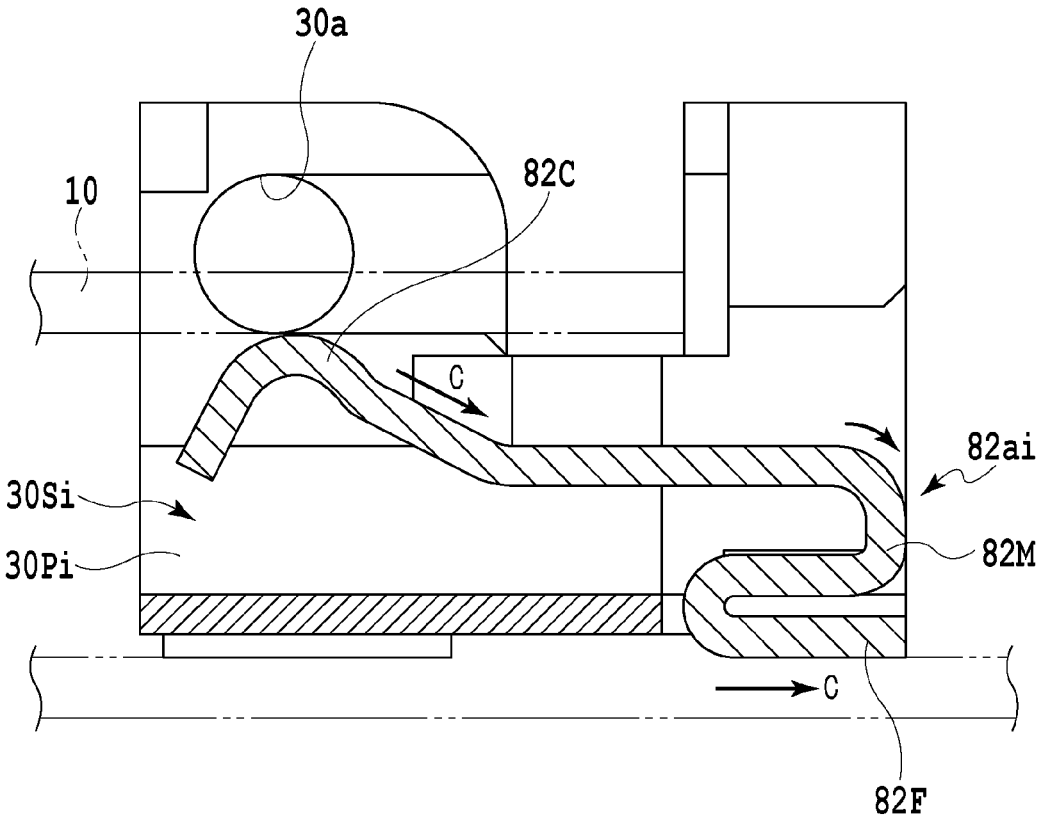
FIG. 14 is a partial cross-sectional view taken along a XIV-XIV line in FIG. 12.

The fixed terminal portions 32F of the contact terminals 32*ai* used in the cable connector shown in FIG. 4 project from the open end portions of the slits 30Si adjacent to the cable insertion slot toward the first board 24A as shown in FIG. 3. Instead, fixed terminal portions 82F of contact terminals 82*ai* used in the cable connector shown in FIG. 11 are electrically connected from the back wall 30BW to the first board 24A through the slits 30Si as shown in FIG. 14.

Note that constituents in FIG. 11 to FIG. 15 which are the same as the constituents in the example shown in FIG. 4 will be designated by the same reference numerals and overlapping description thereof will be omitted.

Figure 12:
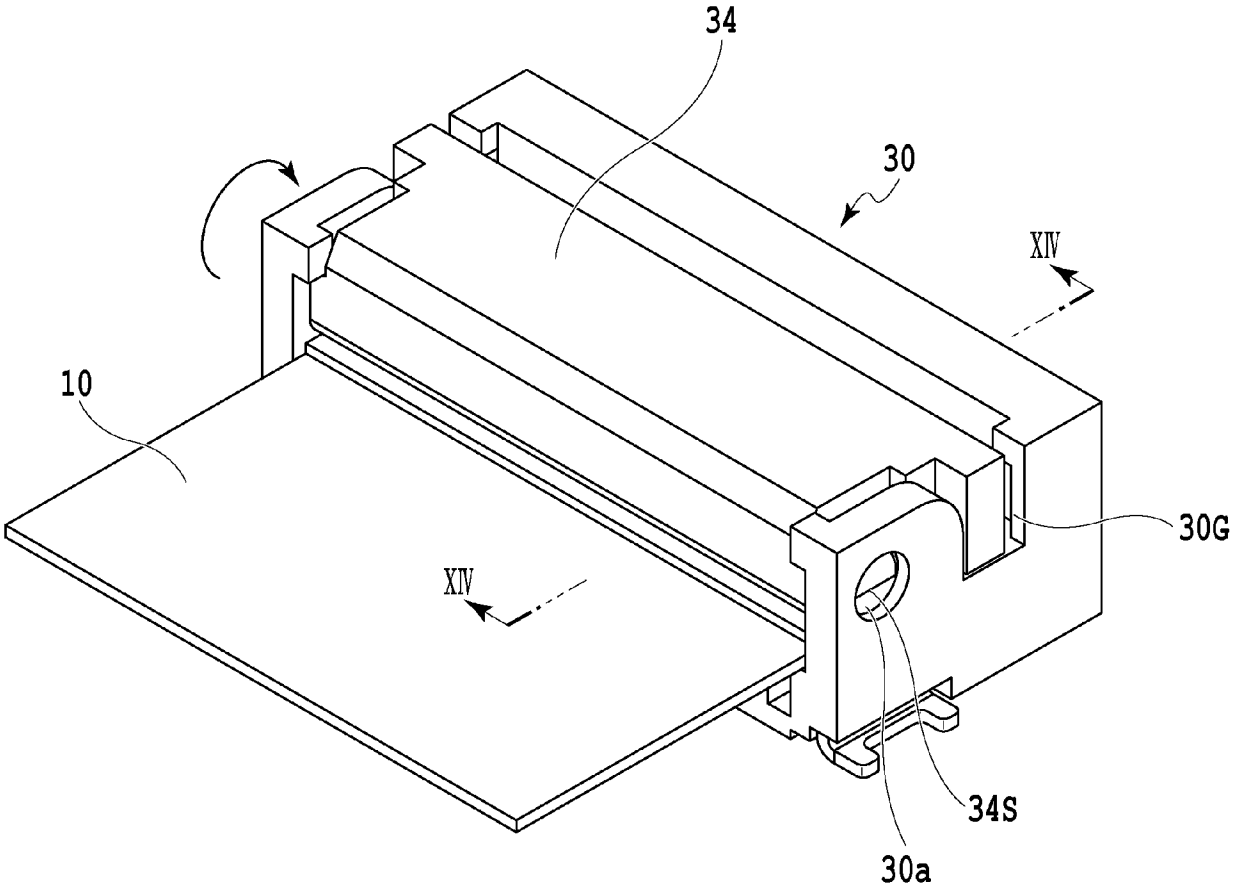
FIG. 12 is a perspective view showing a state where a flexible board is connected in the example shown in FIG. 11.
Figure 13:
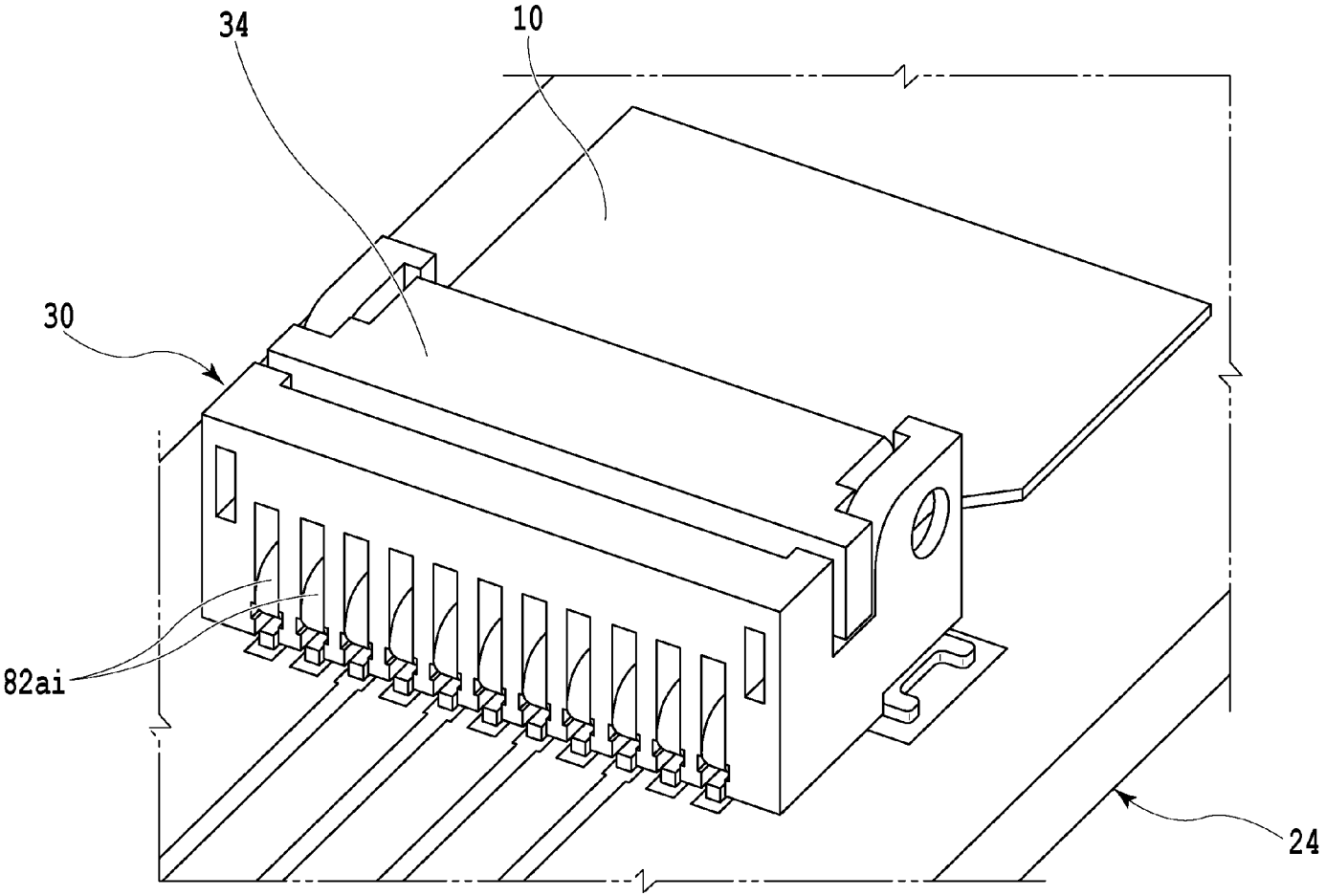
FIG. 13 is another perspective view showing the state where the flexible board is connected in the example shown in FIG. 11.

As shown in FIG. 11, the connection end portions of the flexible boards 10 are to be connected to the cable connector 30, respectively. The cable connector 30 is fixed to the end portion of the mounting surface of the first board 24A. The cable connector 30 includes, as its main elements: the pair of cable end portion accommodating portions into which the connection end portions on the one side of the flexible boards 10 are detachably inserted, respectively; the plurality of contact terminals 82*ai* configured to electrically connect the connection end portions on the one side of the flexible boards 10 to the plurality of signal layers 24S and the plurality of ground layers 24G of the first board 24A; and the pair of lever members 34 configured to press the connection end portions on the one side of the flexible boards 10, which are inserted into the cable end portion accommodating portions, against contact portions of the contact terminals 82*ai* and to hold the connection end portions thereon. Note that FIG. 11 to FIG. 13 illustrate only one of the cable end portion accommodating portions, and illustration of the other cable end portion accommodating portion is omitted therein.

Figure 16:
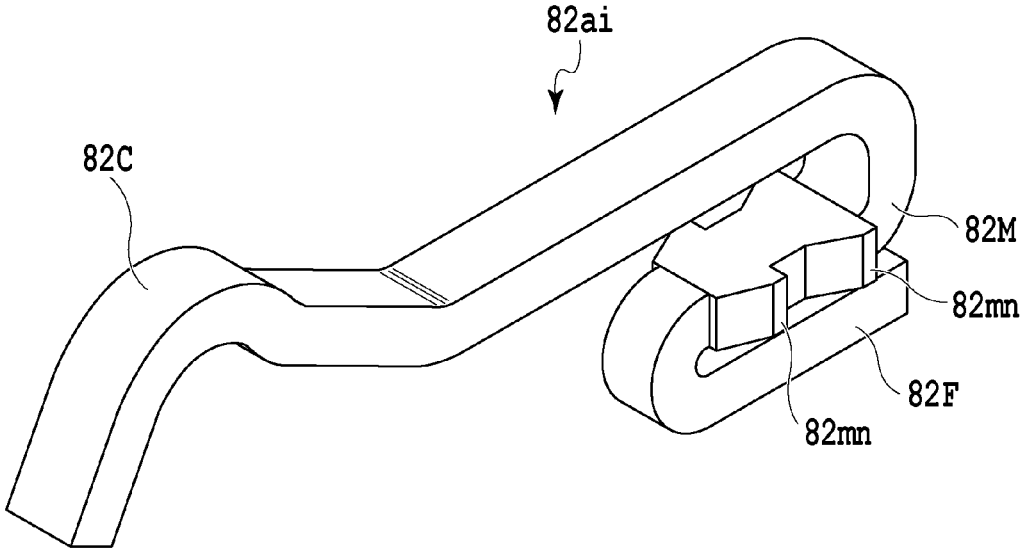
FIG. 16 is a perspective view showing another example of the contact terminal.

As shown in an enlarged manner in FIG. 16, the contact terminals 82*ai* (i=1 to n, n is the positive integer) are made of a thin-plate metal material, for example, and include: contact portions 82C to come into contact with the contact pads 22*ai* (i=1 to n, n is the positive integer) of the connection end portion on the one side of the flexible board 10; the fixed terminal portions 82F to be soldered and fixed to the end portions of the plurality of signal layers 24S and the plurality of ground layers 24G of the first board 24A; and movable pieces 82M to couple the contact portions 82C to the fixed terminal portions 82F.

Figure 15:
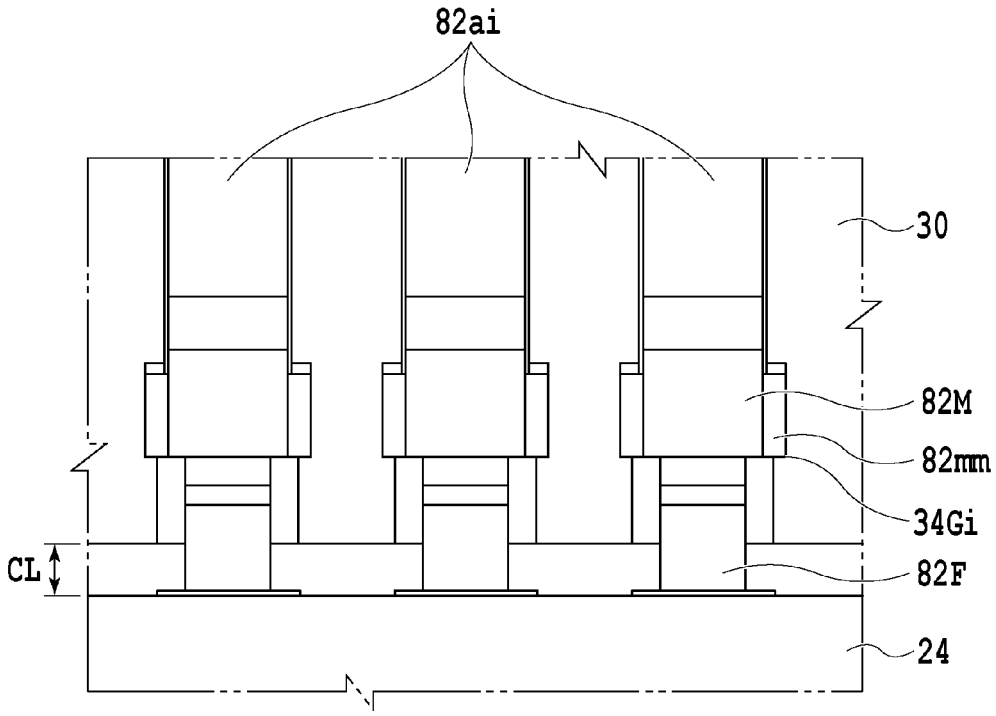
FIG. 15 is an enlarged partial view showing an enlarged part illustrated in FIG. 13.

Each contact portion 82C is bent into an arc shape such that its tip end is directed to the surface of the first board 24A. As shown in FIG. 13 and FIG. 14, the fixed terminal portions 82F are soldered and fixed to the conductive layers of the first board 24A through the slits 30Si. As shown in FIG. 15, a pair of claw portions 82*mn* to be locked with grooves 30Gi in the partition walls 30Pi are provided at two positions of each movable piece 82M (see FIG. 16), and the movable piece 82M extends toward the back wall 30BW and is bent substantially into a U-shape at a position immediately above the fixed terminal portion 82F as shown in FIG. 14. Accordingly, when the pressing surface of the lever member 34 presses the connection end portion on the one side of the flexible board 10 against the contact portions 82C of the plurality of contact terminals 82*ai* and the contact end portion is held therein, a group of signals supplied to the contact terminals 82*ai* through the conductive layers of the flexible board 10 are further supplied to the conductive layers of the first board 24A along a direction indicated with an arrow C in FIG. 14.

Figure 17:
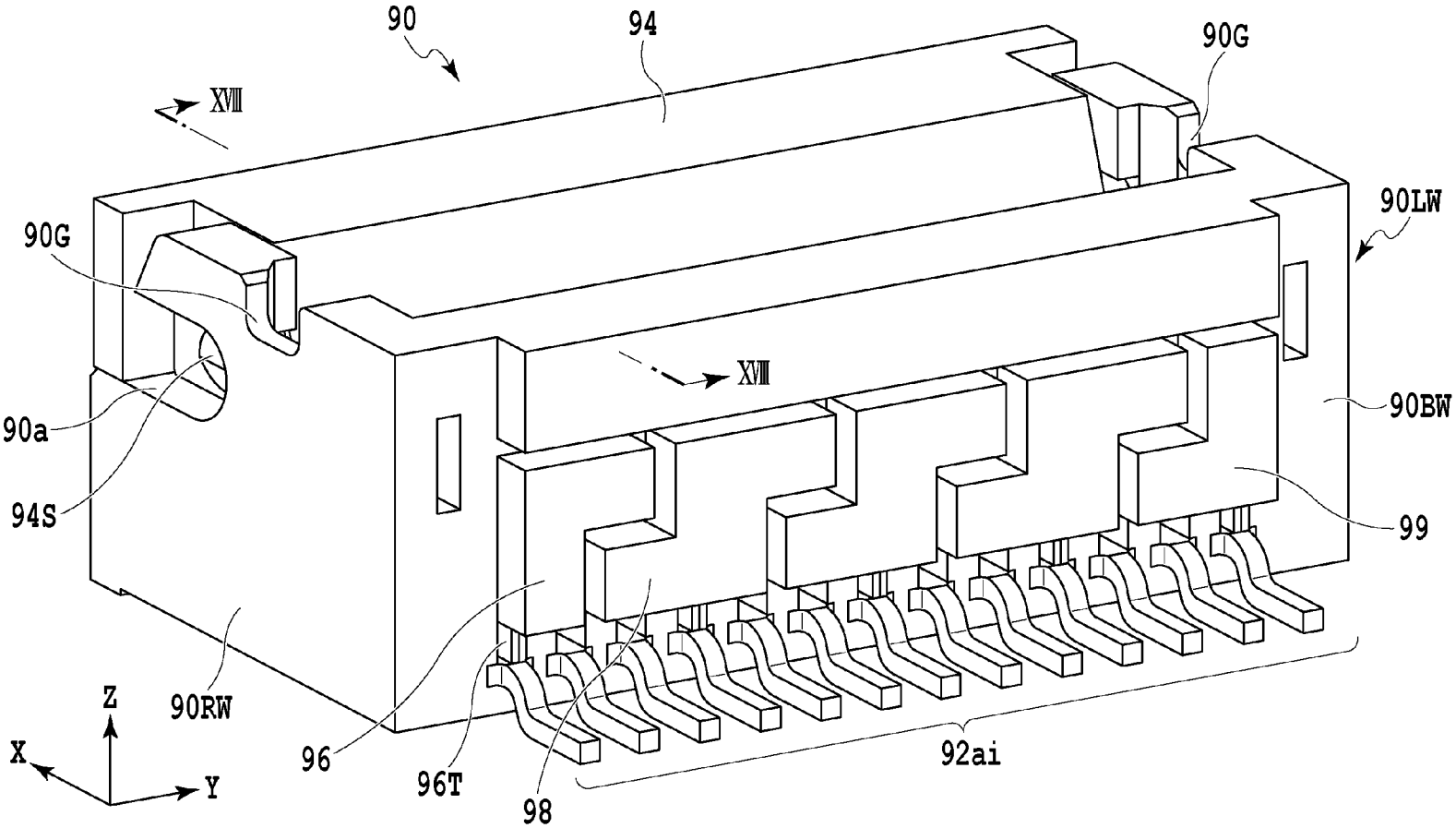
FIG. 17 is a perspective view showing external appearance of still another example of the cable connector to which each embodiment of the cable connection structures according to the present invention are applied.

FIG. 17 shows external appearance of still another example of the cable connector to which the above-described cable connection structures according to the embodiments of the present invention are applied.

As shown in FIG. 17, the connection end portions of the flexible boards 10 described above are to be connected to a cable connector 90, respectively. The cable connector 90 is fixed to the end portion of the mounting surface of the first board 24A described above, which is not illustrated. The cable connector 90 includes, as its main elements: a pair of cable end portion accommodating portions into which the connection end portions on the one side of the flexible boards 10 are detachably inserted, respectively; a plurality of contact terminals 92*ai* configured to electrically connect the connection end portions on the one side of the flexible boards 10 to the plurality of signal layers 24S and the plurality of ground layers 24G of the first board 24A; and a pair of lever members 94 configured to press the connection end portions on the one side of the flexible boards 10, which are inserted into the cable end portion accommodating portions, against contact portions of the plurality of contact terminals 92*ai* and to hold the connection end portions thereon. Note that FIG. 17 illustrates only one of the cable end portion accommodating portions, and illustration of the other cable end portion accommodating portion is omitted therein.

Figure 18:
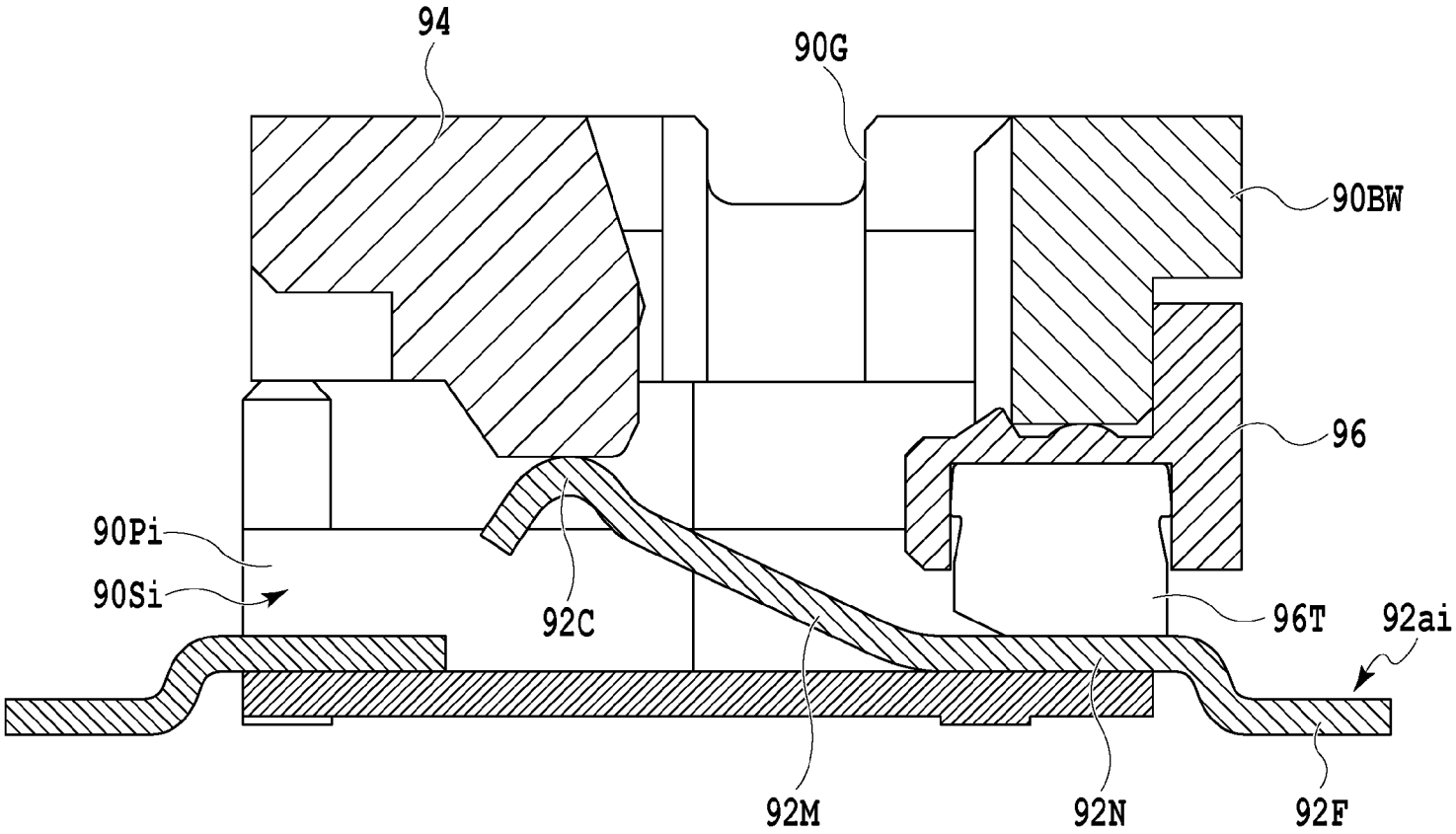
FIG. 18 is a cross-sectional view taken along a XVIII-XVIII line in FIG. 17.

The one of the cable end portion accommodating portions is formed by being surrounded by side walls 90RW and 90LW, a back wall 90BW, and a bottom wall, which collectively constitute a housing. The cable end portion accommodating portion has a cable insertion slot which is opened in the direction of extension of the above-described printed circuit board 24. As shown in FIG. 18, the cable end portion accommodating portion includes a plurality of slits 90Si (i=1 to n, n is the positive integer) to which the contact terminals 92*ai* are provided. The plurality of slits 90Si are formed at given intervals along a Y coordinate axis in FIG. 17. The Y coordinate axis is set parallel to a direction of arrangement of the contact terminals 92*ai*.

The slits 90Si penetrate the back wall 90BW as shown in FIG. 18. Every adjacent slits 90Si are separated from each other by a corresponding one of partition walls 90Pi (i=1 to n, n is the positive integer).

The lever members 94 serving as cable holding means are turnably provided above the cable end portion accommodating portions, respectively. Support shafts 94S formed on two ends of each lever member 94 are inserted into a hole

90*a* in the side wall 90RW and a hole (not shown) in the side wall 90LW. In the case where the flexible board 10 is attached to the cable connector 90 having the above-described configuration, the area of an opening of the cable insertion slot becomes largest when each lever member 94 is turned in one direction. Hence, the connection end portion on the one side of the flexible board 10 is inserted into the insertion slot. Thereafter, the lever member 94 is turned in another direction, which is an opposite direction to the one direction mentioned above, until tabs of the lever member 94 are inserted into grooves 90G in the side walls 90RW and 90LW. Thus, a pressing surface of the lever member 94 presses the connection end portion on the one side of the flexible board 10 against contact portions 92C of the plurality of contact terminals 92*ai*, and the contact end portion is held in the corresponding cable end portion accommodating portion.

As shown in an enlarged manner in FIG. 18, the contact terminals 92*ai* (i=1 to n, n is the positive integer) are made of a thin-plate metal material, for example, and include: the contact portions 92C to come into contact with the contact pads 22*ai* of the connection end portion on the one side of the flexible board 10; fixed terminal portions 92F to be soldered and fixed to the end portions of the plurality of signal layers 24S and the plurality of ground layers 24G of the first board 24A; and movable pieces 92M and fixed portions 92N to couple the contact portions 92C to the fixed terminal portions 92F.

Each contact portion 92C is bent into an arc shape such that its tip end is directed to the surface of the first board 24A. The fixed terminal portions 92F are soldered and fixed to the conductive layers of the first board 24A through the slits 30Si. A pair of claw portions to be locked with the grooves in the partition walls 30Pi are provided at two positions of each fixed portion 92N, and the fixed portion 92N extends toward the back wall 90BW. Accordingly, when the pressing surface of the lever member 94 presses the connection end portion on the one side of the flexible board 10 against the contact portions 92C of the contact terminals 92*ai* and the contact end portion is held thereon, a group of signals supplied to the contact terminals 92*ai* through the conductive layers of the flexible board 10 reach the fixed terminal portions 92F from the contact portions 92C through the movable pieces 92M as well as the fixed portions 92N, and are further supplied to the conductive layers of the first board 24A.

In addition, metallic contact pieces 96T, 98T, and 99T of a conductive block unit come into contact with the fixed portions 92N of particular contact terminals 92*ai* among the contact terminals 92*ai*, which are electrically connected to the ground line conductive layers (G) of the flexible board 10. Contact terminals 92*ai* to be electrically connected to two signal line conductive layers (S) are provided at a given interval between the particular contact terminals 92*ai* that are electrically connected to the ground line conductive layers (G).

The conductive block unit is provided inside an opening of the back wall 90BW, which is opened above the fixed portions 92N of the plurality of contact terminals 92*ai*.

Figure 19:
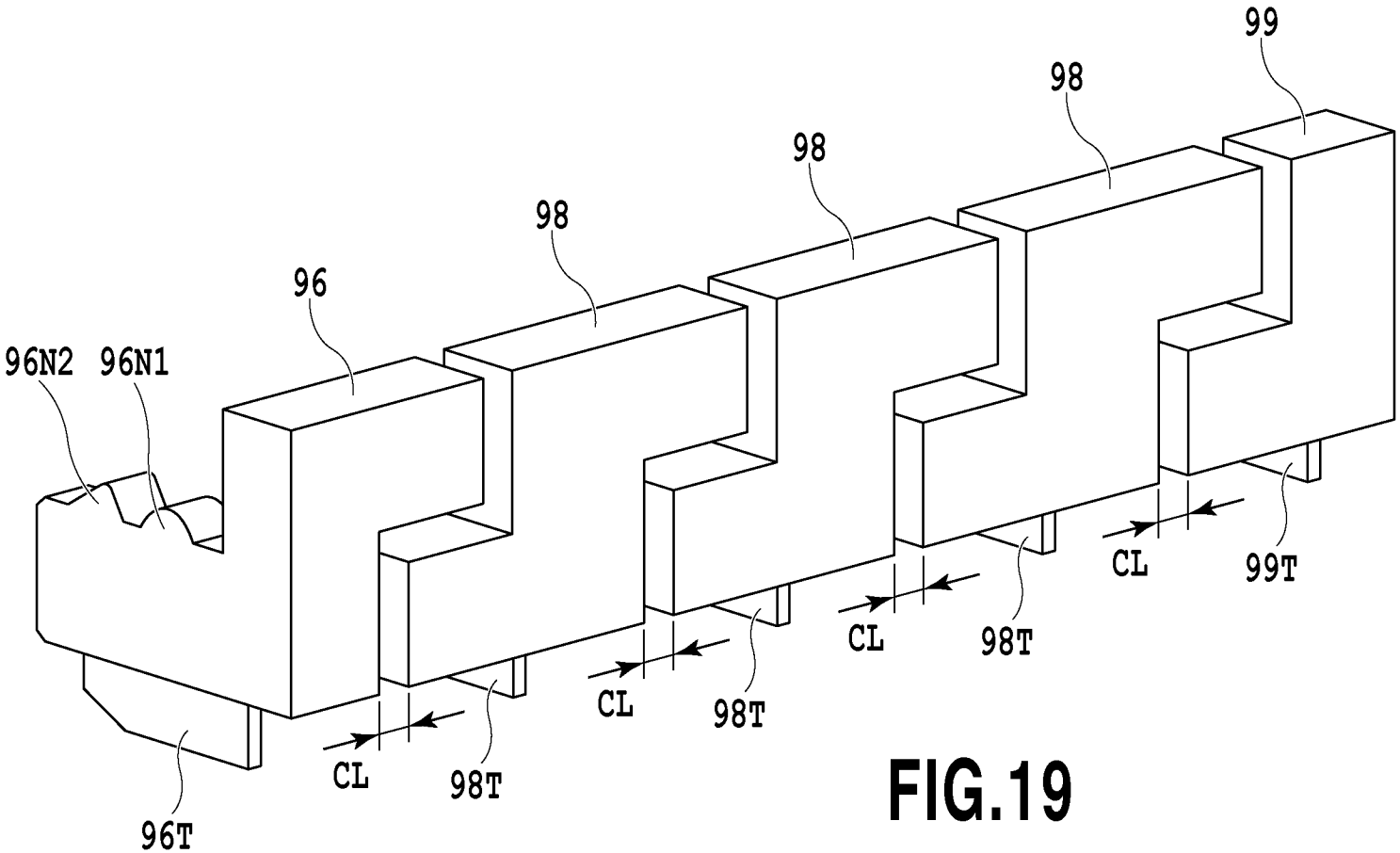
FIG. 19 is a perspective view showing a conductive block unit to be used in the example shown in FIG. 17.

As shown in an enlarged manner in FIG. 19, the conductive block unit includes a block 96, three blocks 98, and a block 99.

In FIG. 19, the block 96 constituting a left end of the conductive block unit is made of a conductive resin material and formed into an angular shape having a corner at an upper left end. A lock portion extending to a position immediately above the fixed portion 92N of the corresponding contact terminal 92*ai* is formed at an end on one side of the block 96. The lock portion includes lock projections 96N1 and 96N2, which are located on a surface opposed to a peripheral edge of the above-described opening. In addition, a groove into which the contact piece 96T is press-fitted is provided in a surface of the lock portion opposed to the fixed portion 92N of the contact terminal 92*ai*. A lower end of the contact piece 96T is in contact with the fixed portion 92N of the contact terminal 92*ai* electrically connected to the corresponding ground line conductive layer (G).

The block 99 constituting a right end of the conductive block unit is made of a conductive resin material and formed into an angular shape having a corner at a lower right end. A lock portion extending to a position immediately above the fixed portion 92N of the corresponding contact terminal 92*ai* is formed at an end on one side of the block 99. The lock portion includes lock projections, which are located at two positions adjacent to each other on a surface opposed to the peripheral edge of the above-described opening. These lock projections have similar structures as the lock projections 96N1 and 96N2. In addition, a groove into which the contact piece 99T is press-fitted is provided in a surface of the lock portion opposed to the fixed portion 92N of the contact terminal 92*ai*. A lower end of the contact piece 99T is in contact with the fixed portion 92N of the corresponding contact terminal 92*ai*.

Each of the three blocks 98 having the same shape is made of a conductive resin material and formed into a crank shape having a first side and a second side. A lock portion extending to a position immediately above the fixed portion 92N of the corresponding contact terminal 92*ai* is formed at an end of the first side of each block 98. The lock portion includes lock projections, which are located at two positions adjacent to each other on a surface opposed to the peripheral edge of the above-described opening. These lock projections have similar structures as the lock projections 96N1 and 96N2. In addition, a groove into which the contact piece 98T is press-fitted is provided in a surface of the lock portion opposed to the fixed portion 92N of the contact terminal 92*ai*. A lower end of the contact piece 98T is in contact with the fixed portion 92N of the corresponding contact terminal 92*ai*. The first side of the block 98 is coupled to the second side of the adjacent block 98 with a metallic coupler. Thus, a given clearance CL is defined between every two adjacent blocks 98. Moreover, the first side of the block 98 adjacent to the left-end block 96 is coupled to the other side of the block 96 with a metallic coupler. Thus, a given clearance CL is also defined between the left-end block 96 and the block 98 adjacent to the block 96. Furthermore, the second side of the block 98 adjacent to the right-end block 99 is coupled to the other side of the block 99 with a metallic coupler. Thus, a given clearance CL is also defined between the right-end block 99 and the block 98 adjacent to the block 99.

Accordingly, the block 96, the blocks 98, and the block 99 collectively form the conductive block unit by being linearly arranged and coupled to one another.

Note that the block 96, the blocks 98, and the block 99 are not limited to the above-described example. Specifically, the adjacent blocks do not have to be coupled to one another with the metallic couplers.

The inventor of the present application has confirmed that, regarding transmission characteristics of the group of signals obtained through the cable connector 90, a peak of the insertion loss and a peak of the crosstalk are attenuated in a predetermined frequency range since the contact terminals 92*ai* electrically connected to the ground line conductive layers (G) are set to the same electric potential as each other according to the above-described configuration.

Figure 20:
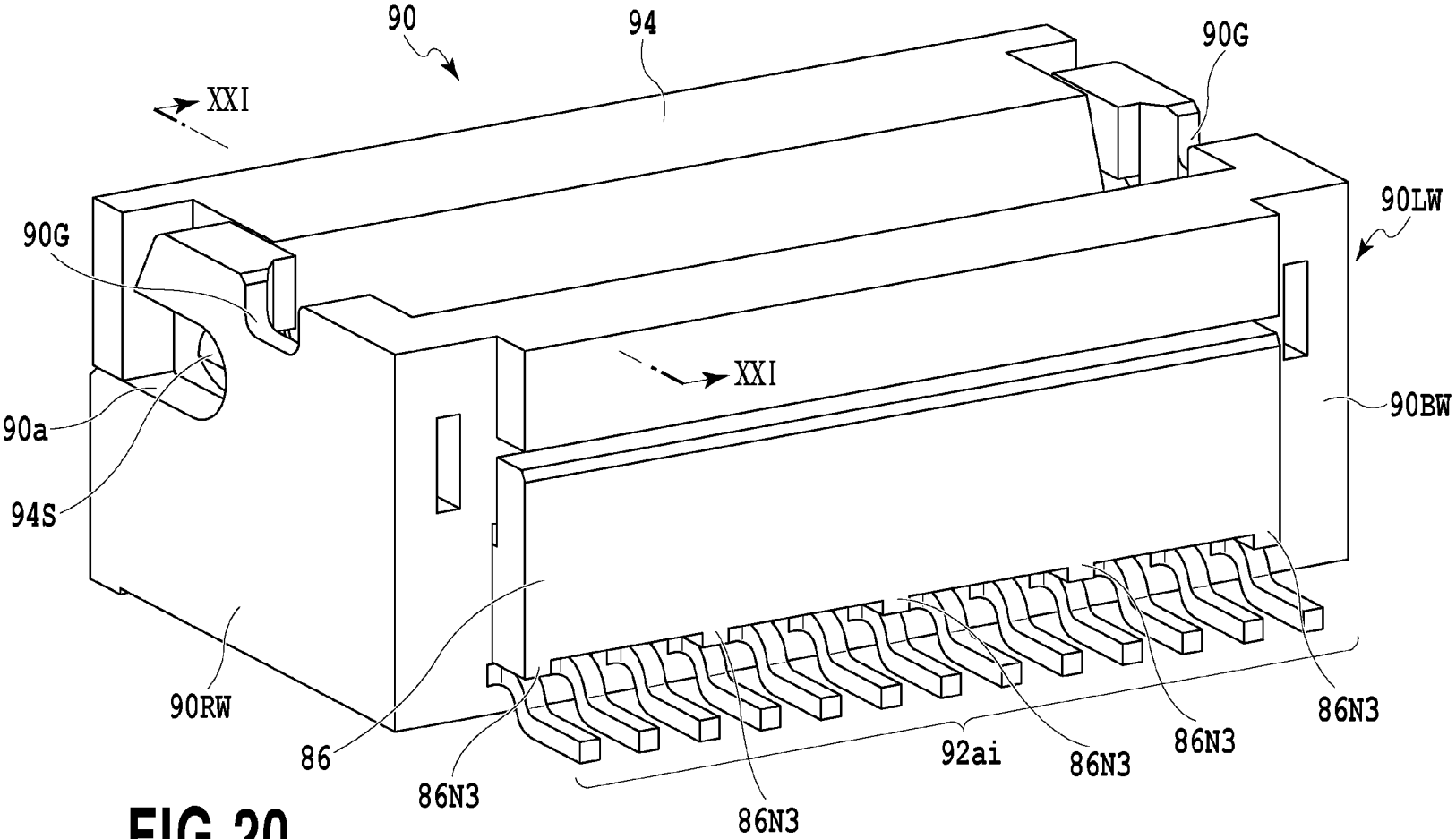
FIG. 20 is a perspective view showing a cable connector including a variation of the conductive block unit.

FIG. 20 shows the cable connector 90 including a modified example of the above-described conductive block unit. The cable connector 90 shown in FIG. 17 includes the conductive block unit formed from the plurality of blocks. Instead, in the example shown in FIG. 20, the cable connector 90 includes a single conductive block 86 that is integrally formed. Note that constituents in FIG. 20 which are the same as the constituents in the example shown in FIG. 17 will be designated by the same reference numerals and overlapping description thereof will be omitted.

The conductive block 86 made of a conductive resin material extends in the Y coordinate axis, and is provided inside the opening of the back wall 90BW which is opened above the fixed portions 92N of the plurality of contact terminals 92*ai*.

Figure 21:
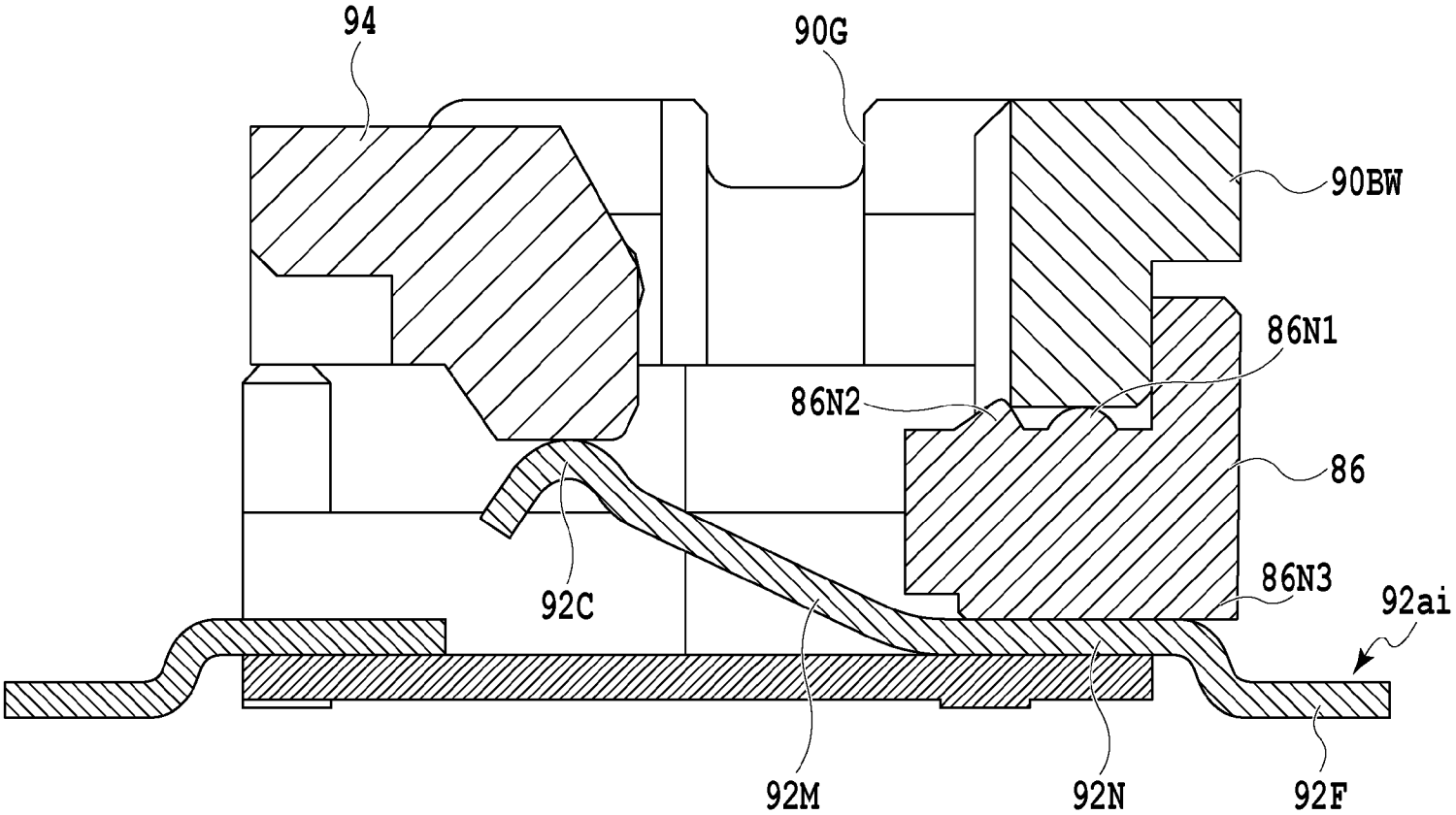
FIG. 21 is a cross-sectional view taken along a XXI-XXI line in FIG. 20.

As shown in FIG. 21, the conductive block 86 is provided with a lock portion extending to a position immediately above the fixed portion 92N of the corresponding contact terminal 92*ai*. The lock portion includes lock projections 86N1 and 86N2, which are located on a surface opposed to the peripheral edge of the above-described opening. In addition, as shown in FIG. 20, projections 86N3 to come into contact with the fixed portions 92N of the particular contact terminals 92*ai* electrically connected to the ground line conductive layers (G) are formed at five positions at given intervals, for example, on a surface of the lock portion opposed to the fixed portions 92N of the contact terminals 92*ai*. Each projection 86N3 projects by a predetermined height toward the fixed portion 92N of the corresponding contact terminal 92*ai* located immediately therebelow.

Figure 22:
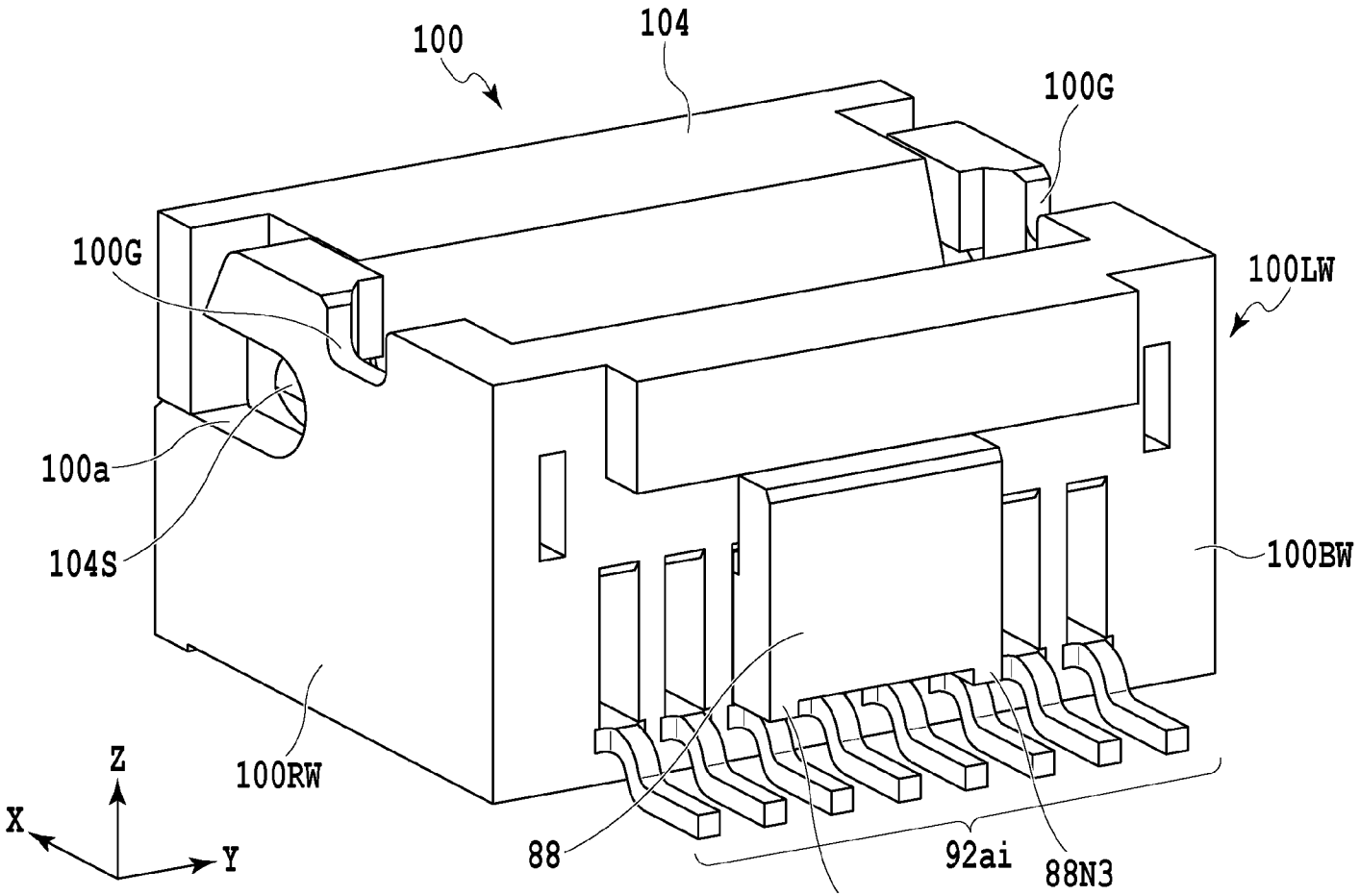
FIG. 22 is a perspective view showing external appearance of yet another example of the cable connector to which each embodiment of the cable connection structures according to the present invention are applied.

FIG. 22 shows external appearance of yet another example of the cable connector to which the above-described cable connection structures according to the embodiments of the present invention are applied.

The cable connector shown in FIG. 22 includes the contact terminals 92*ai* in a fewer number than that of the contact terminals 92*ai* provided to the cable connector shown in FIG. 20, and also includes a conductive block 88 in a smaller size than the size of the conductive block 86. Note that constituents in FIG. 22 which are the same as the constituents in the example shown in FIG. 20 will be designated by the same reference numerals and overlapping description thereof will be omitted.

The connection end portions of the flexible boards 10 described above are to be connected to a cable connector 100, respectively. The cable connector 100 is fixed to the end portion of the mounting surface of the first board 24A described above, which is not illustrated. The cable connector 100 includes, as its main elements: the pair of cable end portion accommodating portions into which the connection end portions on the one side of the flexible boards 10 are detachably inserted, respectively; the plurality of contact terminals 92*ai* configured to electrically connect the connection end portions on the one side of the flexible boards 10 to the plurality of signal layers 24S and the plurality of ground layers 24G of the first board 24A; and a pair of lever members 104 configured to press the connection end portions on the one side of the flexible boards 10, which are inserted into the cable end portion accommodating portions, against the contact portions of the plurality of contact terminals 92*ai* and to hold the connection end portions thereon. Note that FIG. 22 illustrates only one of the cable end portion accommodating portions, and illustration of the other cable end portion accommodating portion is omitted therein.

The one of the cable end portion accommodating portions is formed by being surrounded by side walls 100RW and 100LW, a back wall 100BW, and a bottom wall, which collectively constitute a housing. The cable end portion accommodating portion has a cable insertion slot which is opened in the direction of extension of the above-described printed circuit board 24. Each cable end portion accommodating portion includes a plurality of slits to which the contact terminals 92*ai* are provided. The plurality of slits are formed at given intervals along a Y coordinate axis in FIG. 22. The Y coordinate axis is set parallel to the direction of arrangement of the contact terminals 92*ai*.

The slits penetrate the back wall 100BW. Every adjacent slits are separated from each other by a partition wall.

The lever members 104 serving as cable holding means are turnably provided above the cable end portion accommodating portions, respectively. Support shafts 104S formed on two ends of each lever member 104 are inserted into a hole 100*a* in the side wall 100RW and a hole (not shown) in the side wall 100LW. In the case where the flexible board 10 is attached to the cable connector 100 having the above-described configuration, the area of an opening of the cable insertion slot becomes largest when each lever member 104 is turned in one direction. Hence, the connection end portion on the one side of the flexible board 10 is inserted into the insertion slot. Thereafter, the lever member 104 is turned in another direction, which is an opposite direction to the one direction mentioned above, until tabs of the lever member 104 are inserted into grooves 100G in the side walls 100RW and 100LW. Thus, a pressing surface of the lever member 104 presses the connection end portion on the one side of the flexible board 10 against the contact portions 92C of the plurality of contact terminals 92*ai*, and the contact end portion is held in the corresponding cable end portion accommodating portion.

In addition, projections 88N3 of the conductive block 88 come into contact with the fixed portions 92N of particular contact terminals 92*ai* among the contact terminals 92*ai*, which are electrically connected to the ground line conductive layers (G) of the flexible board 10. Contact terminals 92*ai* to be electrically connected to two signal line conductive layers (S) are provided at a given interval between the particular contact terminals 92*ai* that are electrically connected to the ground line conductive layers (G).

The conductive block 88 made of a conductive resin material extends in the Y coordinate axis, and is provided inside an opening of the back wall 100BW which is opened above the fixed portions 92N of the plurality of contact terminals 92*ai*.

The conductive block 88 is provided with a lock portion extending to a position immediately above the fixed portion 92N of the corresponding contact terminal 92*ai*. The lock portion includes lock projections, which are located at two positions on a surface opposed to a peripheral edge of the above-described opening. In addition, projections 88N3 to come into contact with the fixed portions 92N of the particular contact terminals 92*ai* electrically connected to the ground line conductive layers (G) are formed at two positions at a given interval, for example, on a surface of the lock portion opposed to the fixed portions 92N of the contact terminals 92*ai*. Each projection 88N3 projects by a predetermined height toward the fixed portion 92N of the corresponding contact terminal 92*ai* located immediately therebelow.

In this example as well, the inventor of the present application has confirmed that, regarding transmission characteristics of a group of signals obtained through the cable connector 100, a peak of an insertion loss and a peak of crosstalk are attenuated in a predetermined frequency range since the contact terminals 92*ai* electrically connected to the ground line conductive layers (G) are set to the same electric potential as each other according to the above-described configuration.

Figure 23:
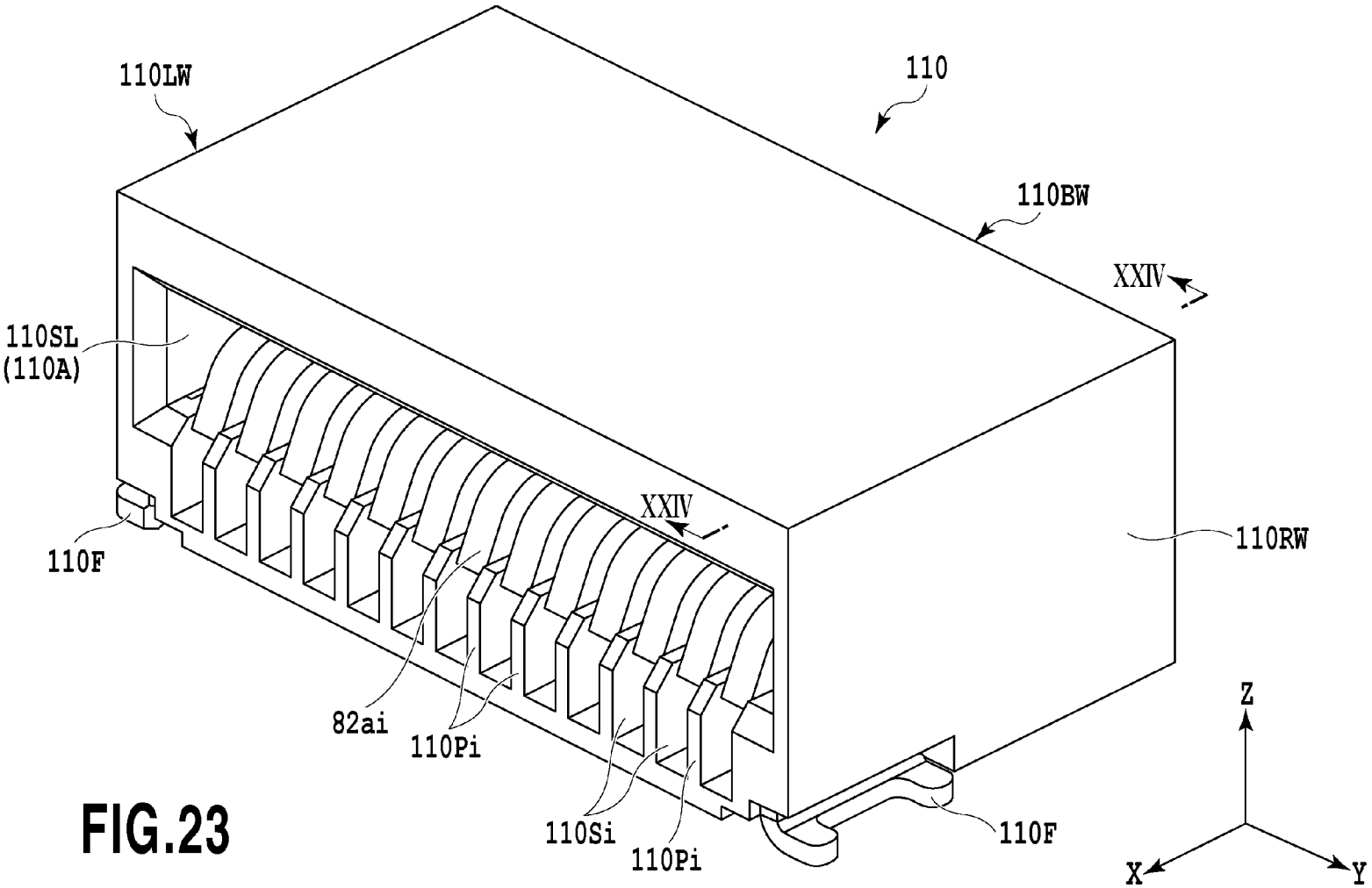
FIG. 23 is a perspective view showing external appearance of an example of the cable connector using another example of contact terminals and being applied in each embodiment of the cable connection structures according to the present invention.

FIG. 23 shows external appearance of another example of the cable connector to which the above-described cable connection structures according to the embodiments of the present invention are applied.

The cable connector shown in FIG. 11 includes the pair of lever members 34. Instead, in the example shown in FIG. 23, the contact end portion 15 of the flexible board 10 is held in a cable end portion accommodating portion 110A of a cable connector 110 due to the contact pressure (elastic repulsion) of the contact portions 82C of the contact terminals 82*ai* without using the pair of lever members 34. The contact pressure of the contact portions 82C of the contact terminals 82*ai* is exerted on the contact end portion 15 of the flexible board 10 in a direction indicated with an arrow in FIG. 24, that is, in a direction toward the inner surface of an upper wall which forms the cable end portion accommodating portion 110A of the cable connector 110. Note that constituents in FIG. 23 and FIG. 24 which are the same as the constituents in the example shown in FIG. 11 will be designated by the same reference numerals and overlapping description thereof will be omitted. Note that FIG. 23 and FIG. 24 illustrate only one of the cable end portion accommodating portions 110A, and illustration of the other cable end portion accommodating portion is omitted therein.

Figure 24:
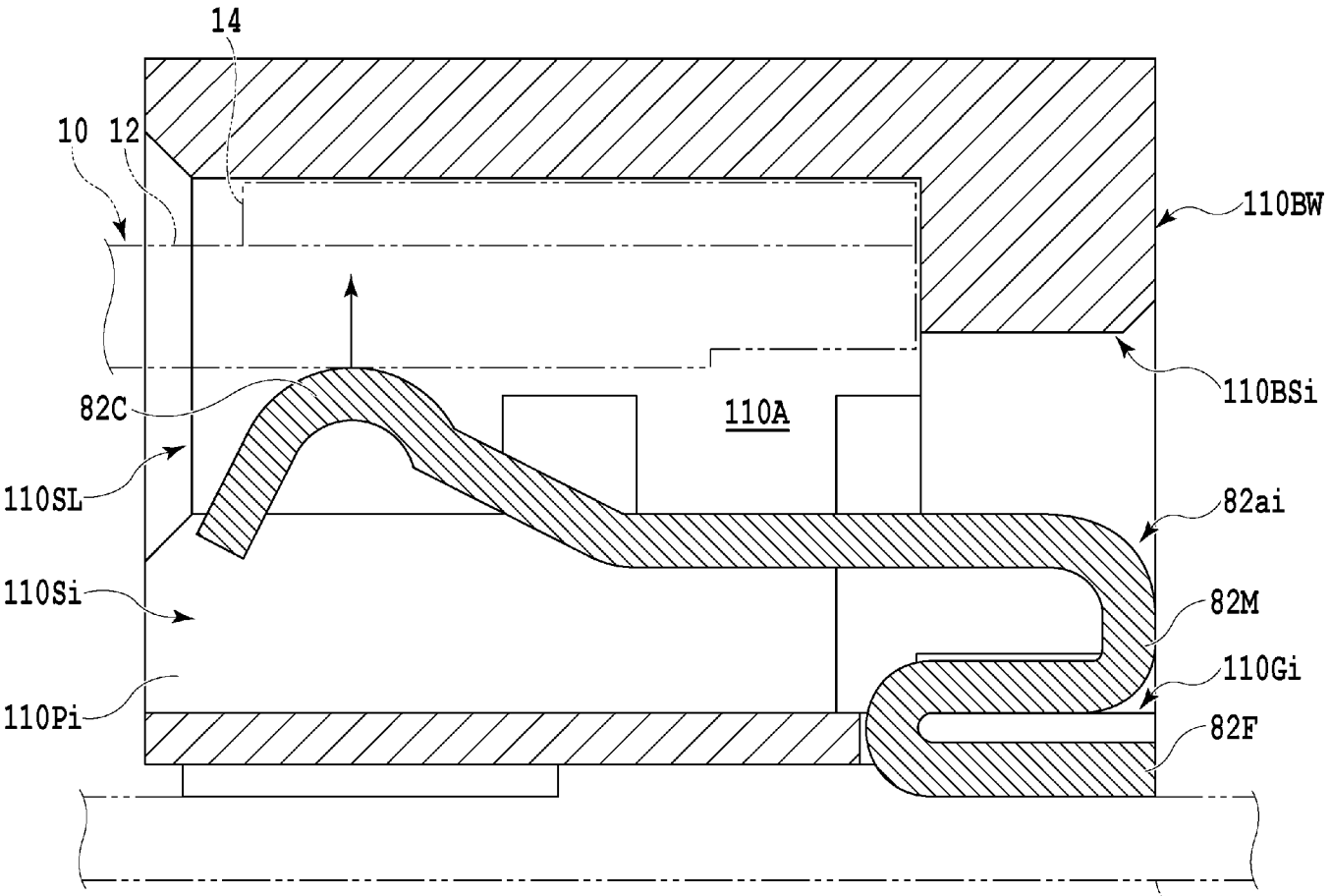
FIG. 24 is a cross-sectional view taken along a XXIV-XXIV line in FIG. 23.

As shown in FIG. 24, the cable connector 110 is fixed to an end portion of the mounting surface of the first board 24A of the printed circuit board 24. The cable connector 110 comprises, as its main elements: the pair of cable end portion accommodating portions 110A into which the connection end portions 15 on one side of the flexible boards 10 are detachably inserted, respectively; and the contact terminals 82*ai* configured to electrically connect the connection end portions 15 on the one side of the flexible boards 10 to the plurality of signal layers 24S and the plurality of ground layers 24G of the first board 24A.

The cable end portion accommodating portion 110A is formed by being surrounded by side walls 110RW and 110LW, the upper wall connecting upper ends of the side walls 110RW and 110LW, a back wall 110BW, and a bottom wall connecting lower ends of the side walls 110RW and 110LW, which collectively constitute a housing. The cable end portion accommodating portion 110A has a cable insertion slot 110SL which is opened in a direction of extension of the printed circuit board 24. The cable end portion accommodating portion 110A includes a plurality of slits 110Si (i=1 to n, n is the positive integer) in which the contact terminals 82*ai* are arranged. The plurality of slits 110Si are formed at given intervals along the Y coordinate axis in FIG. 23. Each slit 110Si is in communication with a corresponding one of slits 110BSi of the back wall 110BW (i=1 to n, n is the positive integer). Adjacent slits 110Si are separated from each other by a corresponding one of partition walls 110Pi (i=1 to n, n is the positive integer). A pair of nib portions (not shown) of the movable pieces 82M of the contact terminals 82*ai* are attached with grooves 110Gi in the partition walls 110Pi. The above-described bottom wall is fixed with a fixing fitting 110F to an end portion of the mounting surface of the first board 24A of the printed circuit board 24.

In the case where the flexible board 10 is connected to the cable connector 110 in the above-described configuration, when the connection end portion 15 on one side of the flexible boards 10 is inserted into the cable end portion accommodating portion 110A against the elastic force of the contact portions 82C of the plurality of contact terminals 82*ai* via the cable insertion slot 110SL, the contact portions 82C of the plurality of contact terminals 82*ai* is depressed, and then, the connection end portion 15 is positioned at a predetermined position. Thus, the contact pressure (elastic repulsion) of the contact portions 82C of the plurality of contact terminals 82*ai* presses the reinforcing plate 14 of the connection end portion 15 on the one side of the flexible board 10 against the inner surface of the upper wall, and the contact end portion 15 is held thereon. Accordingly, a group of signals supplied to the contact terminals 82*ai* through the conductive layers of the flexible board 10 are further supplied to the conductive layers of the first board 24A of the printed circuit board 24.

When the flexible board 10 is detached from the cable connector 110, the connection end portion 15 on the one side of the flexible board 10 is forcefully pulled out of the cable end portion accommodating portion 110A against the elastic force (elastic repulsion) of the contact portions 82C of the plurality of contact terminals 82*ai* via the cable insertion slot 110SL and thus detached from the cable connector 110.

Note that the examples of the cable connection structures according to the present invention are not limited to the application to the above-described transceiver module but are, of course, also applicable to cable connecting parts of other devices, for instance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A cable connection structure comprising:

a connection end portion of a flexible cable, the flexible cable having a group of contact pads formed at least at one ends of a plurality of signal lines configured to transmit a signal and one ends of a plurality of ground lines to be grounded, a ground plate electrically connected to the plurality of ground lines with respect to the contact pads, and a reinforcing plate provided on a surface of the ground plate with respect to the contact pads, the connection end portion which the ground plate and the reinforcing plate are oppositely joined to the group of contact pads;

the connection end portion comprising:

a plurality of contact terminals each having a contact portion to come into contact with a corresponding one of the contact pads, the contact terminals provided in a housing, being configured to electrically connect the connection end portion of the cable to a wiring board, wherein the connection end portion is held in the housing due to elastic repulsion of the contact portion of the plurality of contact terminals pressed against the group of contact pads.

2. The cable connection structure according to claim 1, wherein the ground plate has a plurality of extension portions formed at a given interval along a direction of arrangement of the contact terminals.

3. The cable connection structure according to claim 2, wherein a ground plate piece to be electrically connected to the corresponding ground line is further formed between the extension portions adjacent to each other.

4. The cable connection structure according to claim 1, wherein a plurality of ground plate pieces to be electrically connected to the ground lines are further formed away from the ground plate and disposed at a given interval along a direction of arrangement of the contact terminals.

* * * * *